US008185030B2

(12) United States Patent
Seo et al.

(10) Patent No.: US 8,185,030 B2
(45) Date of Patent: May 22, 2012

(54) FIXER, IMAGE FORMING APPARATUS INCLUDING SAME, AND FIXING METHOD

(75) Inventors: Hiroshi Seo, Sagamihara (JP); Takamasa Hase, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 464 days.

(21) Appl. No.: 12/408,318

(22) Filed: Mar. 20, 2009

(65) Prior Publication Data

US 2009/0245897 A1 Oct. 1, 2009

(30) Foreign Application Priority Data

Mar. 25, 2008 (JP) ..... 2008-078723

(51) Int. Cl.
*G03G 15/20* (2006.01)
*H05B 6/14* (2006.01)

(52) U.S. Cl. ..... 399/328; 219/619; 399/330; 399/336

(58) Field of Classification Search ..... 399/69, 399/328, 330, 334, 336; 219/619, 660, 671, 219/672

See application file for complete search history.

(56) References Cited

U.S. PATENT DOCUMENTS 6,246,843 B1 * 6/2001 Nanataki et al. ..... 399/45
6,810,230 B2 * 10/2004 Imai et al. ..... 399/328
6,872,925 B2 * 3/2005 Asakura et al. ..... 219/619
6,901,235 B2 * 5/2005 Shimizu et al. ..... 399/328
6,954,608 B2 * 10/2005 Sekiguchi et al. ..... 399/334
7,094,997 B2 * 8/2006 Kinouchi et al. ..... 219/619
7,496,303 B2 * 2/2009 Kamoda ..... 399/45
7,756,459 B2 * 7/2010 Ohno ..... 399/328
7,764,916 B2 * 7/2010 Kagawa ..... 399/334
7,856,190 B2 * 12/2010 Kishi ..... 399/67
2005/0067408 A1 3/2005 Fujii et al.
2007/0212089 A1 9/2007 Seo et al.
2007/0242988 A1 10/2007 Seo et al.
2007/0280754 A1 12/2007 Ogawa et al.

(Continued)

FOREIGN PATENT DOCUMENTS

EP 2 071 414 A1 6/2009

(Continued)

OTHER PUBLICATIONS

U.S. Appl. No. 12/332,784, filed Dec. 11, 2008, Seo, et al.

(Continued)

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

A fixer includes a fixing member with a rotary heat generator, a pressure member, an excitation coil disposed facing a heat generation layer of the rotary heat generator to generate magnetic flux that inductively heats the heat generation layer, a loop-shaped demagnetization coil unit disposed facing the heat generation layer to generate magnetic flux that partly counteracts the magnetic flux generated by the excitation coil, a first magnetic core disposed in a first area that is enclosed by both the excitation coil and the demagnetization coil unit, and a second magnetic core disposed in a second area that is outside a loop of the demagnetization coil unit and enclosed by the excitation coil. The first magnetic core and the second magnetic core are magnetically continuous in a rotary axial direction of the rotary heat generator. A fixing method fixes an image on the sheet used in a fixer.

19 Claims, 24 Drawing Sheets

U.S. PATENT DOCUMENTS

| | | | |
|---|---|---|---|
| 2008/0025772 | A1 | 1/2008 | Seo et al. |
| 2008/0025773 | A1 | 1/2008 | Ito et al. |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2009/0060550 | A1 | 3/2009 | Seo |

FOREIGN PATENT DOCUMENTS

| | | | | |
|---|---|---|---|---|
| JP | O8-016006 | | | 1/1996 |
| JP | 2001-34097 | | | 2/2001 |
| JP | 2005-108603 | A | | 4/2005 |
| JP | 2005-321642 | | | 11/2005 |
| JP | 2006308933 | A | * | 11/2006 |
| JP | 2007-79131 | | | 3/2007 |
| JP | 2007108213 | A | * | 4/2007 |
| JP | 2007-226125 | | | 9/2007 |
| JP | 2007264021 | A | * | 10/2007 |
| JP | 2008-40176 | | | 2/2008 |
| JP | 2008-102403 | A | | 5/2008 |

OTHER PUBLICATIONS

Japanese Office Action issued Mar. 13, 2012 for Japanese Patent Application No. 2008-78723, filed Mar. 25, 2008.

* cited by examiner

FIG. 3C

| | FIXING FAILURE | EXCESSIVE HEATING AT NON-SHEET AREA |
|---|---|---|
| POSTCARD | OK | OK |
| A5T | OK | OK |
| B5T | BAD | OK |
| A4T | BAD | OK |
| B4T | NA | NA |
| A3T | NA | NA |

FIG. 13B

| | FIXING FAILURE | EXCESSIVE HEATING AT NON-SHEET AREA |
|---|---|---|
| POSTCARD | OK | OK |
| A5T | OK | OK |
| B5T | OK | OK |
| A4T | OK | OK |
| B4T | OK | OK |
| A3T | NA | NA |

FIXER, IMAGE FORMING APPARATUS INCLUDING SAME, AND FIXING METHOD

CROSS-REFERENCE TO RELATED APPLICATIONS

This patent specification claims priority from Japanese Patent Application No. 2008-078723, filed on Mar. 25, 2008 in the Japan Patent Office, the entire contents of which are hereby incorporated by reference herein.

BACKGROUND OF THE INVENTION

1. Field of the Invention

The present invention generally relates to a fixer, an image forming apparatus, such as a copier, a printer, a facsimile machine, a multifunction machine, etc., including the same, and a fixing method, and more particularly, to an electromagnetic induction heating fixer, an image forming apparatus including the same, and a fixing method using the same.

2. Discussion of the Background Art

In general, an electrophotographic image forming apparatus, such as a copier, a printer, a facsimile machine, and a multifunction machine including at least two of those functions, forms an electrostatic latent image on an image carrier, develops the latent image with developer such as toner, and transfers the developed image from the image carrier onto a sheet of recording media, such as paper, overhead projector (OHP) film, and the like, after which, the developed image (toner image) is fixed on the sheet.

A fixer is a mechanism that typically includes a fixing member such as a fixing roller and a pressure roller that presses against the fixing roller. The fixing member is heated by a heat source, typically but not necessarily internal to the fixing member, and the fixing member and the pressure roller together sandwich the sheet between them to form a fixing nip where the image formed on the sheet is fixed on the sheet with heat and pressure. This method is hereinafter referred to as the heating-roller fixing method.

Recently, various approaches described below have been tried to reduce both warm-up time and energy consumption of fixers. For example, one known fixer uses a fixing member such as an endless belt or film whose heat capacity is relatively small. Separately, an electromagnetic induction-heating fixing method has been proposed.

An electromagnetic induction-heating fixer generally includes an excitation coil through which a high-frequency electrical current is passed so as to generate a magnetic flux, and a magnetic core for guiding the magnetic flux to a roller-shaped or belt-shaped heat generator efficiently. A fixing nip can be formed by the heat generator and a pressure roller that presses against the heat generator directly or via a fixing member. When the pressure roller presses against the heat generator directly, the heat generator serves as a fixing member.

The magnetic flux causes an eddy current in the heat generator, and thus the heat generator is heated inductively. In this configuration, the heat generator can be promptly heated because the heat generator itself can generate heat, eliminating preheating that is required in the heating-roller fixing method. Thus, the electromagnetic induction-heating fixing method is advantageous in that both warm-up time and energy consumption can be reduced.

However, the electromagnetic induction-heating fixing method still has a problem described below in detail.

Generally, the image forming apparatus can accommodate a variety of different sheet sizes. When sheets whose width, that is, length in a direction perpendicular to a direction in which the sheets are transported (hereinafter "sheet width direction"), is relatively small pass through the fixing nip continuously, lateral end portions of the heat generator (or the fixing member) where the sheets do not pass (hereinafter also "non-sheet area") tend to overheat. This is because heat of a portion of the heat generator where the sheet passes (hereinafter "center portion" or "sheet area") is drawn by the sheet and heat of the lateral end portions is not lost.

Therefore, temperature can rise excessively in the end portions of the heat generator, degrading or even damaging the heat generator. This phenomenon is hereinafter referred to as excessive heating at end portions.

Further, when a sheet whose width is larger than that of the small sheets passes the fixing nip after the small sheets have passes the fixing nip continuously for some time, toner in a resulting image will be partly absent in portions of the sheet that pass the overheated end portions of the heat generator, which is a phenomenon called hot offset. Hot offset occurs because, when toner is heated excessively, cohesion among toner particles is lower than adhesion between the toner particles and the fixing member, thereby, causing toner layers to separate.

In view of the foregoing, one known technique suggests using sub-induction coils or demagnetization coils for counteracting the magnetic flux generated by a main induction coil or excitation coil. The demagnetization coils are respectively provided in end portions of the heat generator except an area to be covered by a sheet whose width is smallest (hereinafter "smallest sheet") among multiple different sheet sizes that the image forming apparatus can accommodate. When the smallest sheet passes the fixing nip, the demagnetization coils are energized so as to counteract the excitation magnetic flux that is to act on the non-sheet area, restricting temperature rise at the end portions. By contrast, when a sheet whose width is larger than the smallest width passes the fixing nip, power is not supplied to the demagnetization coils, and thus the excitation magnetic flux acts on whole the width of the heat generator, heating whole the heat generator.

In this configuration, although excessive heating at end portions (non-sheet area) can be restricted, if the demagnetization coils are relatively far from the area to be covered by the smallest sheet (hereinafter "smallest-sheet area") in the sheet width direction, temperature can excessively rise in portions between the smallest-sheet area and the portions corresponding to the demagnetization coils, degrading those portions. By contrast, if the demagnetization coils overlap the smallest-sheet area in the sheet width direction, the amount of heat will be insufficient in end portions of the smallest-sheet area due to a sudden decrease in the magnetic flux, making the temperature in the smallest-sheet area uneven. Thereby, fixing failure, offset, and/or unevenness in gloss can be caused in a fixed image.

In view of the disadvantage described above, the following techniques have been proposed.

One known technique suggests using a demagnetization coil looped into a particular shape so as to prevent both excessive heating at end portions and unevenness in temperature in the sheet area in an axial direction (sheet width direction) of the fixing member. The demagnetization coil has a curved end portion and is disposed so that the curved end portion overlaps an end portion of the sheet in the sheet width direction. More specifically, because a demagnetization effect of the curved end portion is lower than that of a portion extending in the axial direction, by disposing the curved end portion to overlap the end portion of the sheet in the sheet width direction, differences in temperature between the center portion and the end portions in the sheet width direction of the sheet area can be reduced.

Further, another known technique suggests using divided multiple demagnetization coils each having a particular shape and disposing them in accordance with multiple different sheet sizes. In this technique, the multiple demagnetization coils can be energized separately in accordance with each sheet size.

However, an additional complication in this regard is the relation between arrangement of the magnetic cores and density of the magnetic flux. More specifically, in the known fixers described above having the demagnetization coil whose end portion in the sheet width direction is curved and multiple magnetic cores are arranged in the sheet width direction, the magnetic cores cannot be continuous in the sheet width direction even if the multiple magnetic cores are respectively disposed in areas enclosed by both the excitation coil and the demagnetization coil and an area enclosed by only the excitation coil. Where the center core is partly absent, the magnetic flux density can decrease in a portion of the heat generator facing such a portion, and thus the temperature thereof will drop.

Therefore, there is a need to prevent a drop in temperature of the heat generator as well as excessive heating at the end portions thereof in the sheet width direction, which the known methods fail to do.

SUMMARY OF THE INVENTION

In view of the foregoing, in one illustrative embodiment of the present invention, a fixer for fixing an image on a recording medium includes a fixing member provided with a rotary heat generator, a pressure member to form a nip with the fixing member to sandwich the sheet, an excitation coil disposed facing a heat generation layer of the rotary heat generator to generate magnetic flux that inductively heats the heat generation layer, a loop-shaped demagnetization coil disposed facing the heat generation layer to generate magnetic flux that partly counteracts the magnetic flux generated by the excitation coil, a first magnetic core, and a second magnetic core. The first magnetic core is disposed in a first area that is enclosed by both the excitation coil and the demagnetization coil. The second magnetic core is disposed in a second area located outside a loop of the demagnetization coil and enclosed by the excitation coil. The first magnetic core and the second magnetic core are magnetically continuous in a rotary axial direction of the rotary heat generator.

Another illustrative embodiment of the present invention provides an image forming apparatus including an image carrier on which an electrostatic latent image is formed, a developing unit disposed facing the image carrier to develop the electrostatic latent image with developer, a transfer unit to transfer the developed image onto a sheet of recording media, and the fixer described above.

Yet another illustrative embodiment of the present invention provides a fixing method of fixing an image on a sheet of recording media used in the fixer described above. The fixing method includes generating excitation magnetic flux that inductively heats a heat generation layer of the rotary heat generator, guiding the excitation magnetic flux to the heat generation layer continuously in a rotary axial direction of the rotary heat generator, generating magnetic flux that partly counteracts the excitation magnetic flux obliquely in a sheet width direction depending on sheet size, and passing the sheet through the nip between the fixing member and the pressure member to fix the image on the sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 2A illustrates demagnetization effects in the fixer shown in FIG. 1 when demagnetization coils are on;

FIG. 3C is a table showing evaluation results of the demagnetization effects in the induction heating unit of the comparative fixer;

FIG. 13B is a table showing evaluation results of the demagnetization effects in the induction heating unit shown in FIG. 10;

DETAILED DESCRIPTION OF PREFERRED EMBODIMENTS

Figure 1:
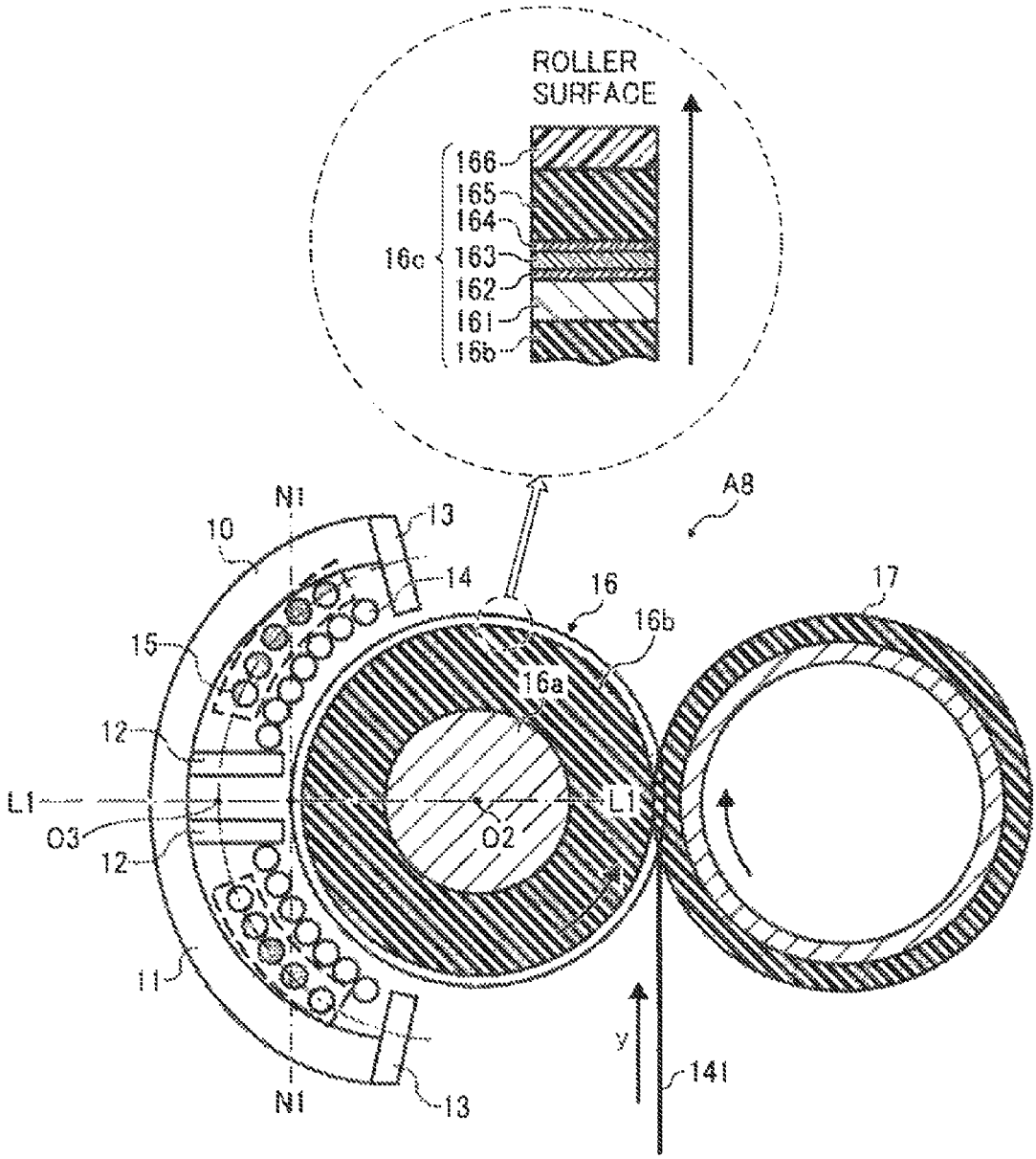
FIG. 1 is an end-on cross-sectional view illustrating a configuration of a fixer according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a fixer to be used in an image forming apparatus according to an illustrative embodiment of the present invention is described.

Referring to FIG. 1, a fixer A8 includes a fixing roller 16 serving as a fixing member, a pressure roller 17 pressing against the fixing roller 16, forming a fixing nip, and an induction heating unit 10 disposed facing the fixing roller 16. The fixing roller 16 includes a metal core 16*a*, an elastic member 16*b*, and a fixing sleeve 16*c* serving as a rotary heat generator. The fixing sleeve 16*c* includes a base layer 161, antioxidant layers 162 and 164, a heat generation layer 163, an elastic layer 165, and a release layer 166. The induction heating unit 10 heats the heat generation layer 163 inductively.

While the fixing roller 16 and the pressure roller 17 sandwich a sheet 141 (recording medium) therebetween and transport it in a direction indicated by arrow y (hereinafter "sheet transport direction"), an image formed on the sheet 141 is fixed thereon with heat and pressure. It is to be noted that the sheet 141 passes through the fixer A8 with a center portion thereof in a width direction aligned with that of the fixing roller 16 in the present embodiment.

It is to be noted that, although the pressure roller 17 presses against the fixing roller 16 directly in the example shown in FIG. 1, alternatively, the pressure roller 17 can press against the fixing roller 16 indirectly via a fixing belt and the like.

The induction heating unit 10 is described below in further detail with reference to FIG. 1.

The induction heating unit 10 is curved along a circumferential surface of the fixing roller 16 so as to partly cover the fixing roller 16 as shown in FIG. 1 and includes an excitation coil 14 disposed facing the heat generation layer 163, demagnetization coil units 15, an arch core 11, a center core 12, and side cores 13. It is to be noted that the center core unit 12 includes center cores 12A and 12B (12B1 and 12B2) that are described below with reference to FIG. 5. The excitation coil 14 heats the heat generation layer 163 inductively by generating magnetic flux (hereinafter also "excitation flux"), and the demagnetization coil units 15 generate magnetic flux that partly counteracts the excitation flux generated by the excitation coil 14 (hereinafter also "demagnetizing flux"). In the example shown in FIG. 1, each demagnetization coil unit 15 includes only a single demagnetization coil.

The excitation coil 14 is looped so as to partly cover the fixing roller 16 as shown in FIG. 1 and is supplied with a high-frequency alternating electrical current by a driving power source, not shown, and thus alternating magnetic flux is generated. It is to be noted that the frequency of the alternating electrical current can be within a range from 10 kHz to 1 MHz, and the range is preferably from 20 kHz to 800 kHz, and hereinafter "current" represents "electrical current" unless otherwise specified.

This alternating magnetic flux acts on the heat generation layer 163 in portions where the excitation coil 14 faces the fixing roller 16 and portions close thereto, and then an eddy current flows therein in a direction to counteract changes in the alternating magnetic flux. Where this eddy current is generated, Joule heat is generated due to electrical resistance of the heat generation layer 163. Thus, the heat generation layer 163 is inductively heated mainly in the portion where the excitation coil 14 faces the fixing roller 16 and portions close thereto.

The demagnetization coil units 15 can prevent or reduce excessive heating at end portions of the fixing roller 16 by counteracting the excitation flux generated by the excitation coil 14 that acts on non-sheet areas of the fixing roller 16 where the sheet 141 does not pass. The demagnetization coil units 15 are disposed corresponding to the non-sheet areas, outside the excitation coil 14 in a diametral direction of the fixing roller 16 so as to overlap the excitation coil 14.

It is to be noted that, when the center portion of the sheet 141 in the sheet width direction is aligned with that of the fixing roller 16 as in the present embodiment, the demagnetization coil units 15 are disposed symmetrically relative to the center portion. By contrast, when an edge portion of the sheet 141 in the sheet width direction is aligned with an edge portion (first edge portion) of the fixing roller 16 in the sheet width direction, the demagnetization coil unit 15 is disposed in the other edge portion (second edge portion) thereof because temperature will rise excessively in the second edge portion where the sheet 141 does not pass.

It is to be noted that, in FIG. 1, reference characters O2 represent a center of a rotary axis of the fixing sleeve 16*c*, O3 represents a center of the looped excitation coil 14, L1-L1 represents a line connecting the centers O2 and O3, and N1-N1 represents a tangent line of the fixing sleeve 16*c* at an intersection point with the line L1-L1. These are described below with reference to FIGS. 5, 6A, 6B, 6C, and 6D.

As described above, in addition to the excitation coil 14 and the demagnetization coil units 15, the induction heating unit 10 includes the center core unit 12 disposed inside the excitation coil 14 in the sheet transport direction indicated by arrow y, which is perpendicular to the sheet width direction, the side cores 13 disposed outside the excitation coil 14 and the demagnetization coil units 15 in the sheet transport direction, and the arch core 11. These cores are formed of ferromagnetic such as ferrite and have a relative permeability of 2500, for example, in the present embodiment.

The center core unit 12 is disposed between the arch core 11 and the fixing roller 16, inside the excitation coil 14 and the demagnetization coil units 15. The center core unit 12 guides the magnetic flux generated by both portions of the excitation coil 14 sandwiching the center core unit 12 to the heat generation layer 163.

The arch core 11 connects the center core unit 12 and the side cores 13 as shown in FIG. 1. It is to be noted that, although the arch core 11 is a single unit connecting the side cores 13 disposed outside the center core unit 12 in the sheet transport direction indicated by arrow y in FIG. 1, alternatively, separate arch cores can be provided on both sides of the center core unit 12, respectively.

The side cores 13 are respectively disposed in both end portions of the curved induction heating unit 10 in the circumferential direction of the fixing roller 16. Each side core 13 extends in the sheet width direction, that is, a direction perpendicular to a surface of the paper on which FIG. 1 is drawn, and is fixed to each end portion of the arch core 11. The center core unit 12 is fixed to a center portion of the arch core 11.

Next, the fixing roller 16 is described below in further detail.

The fixing roller 16 includes the metal core 16*a*, the elastic member 16*b* that covers the metal core 16*a*, and the fixing sleeve 16*c* that is disposed outside the elastic member 16*b*. The metal core 16*a* can be formed with iron, stainless steel, a SUS (Still Use Stainless) still including iron, and the like. The elastic member 16*b* serves as a heat insulation layer and can be formed with thermally-resistant elastic solid or foamed silicone rubber, for example. Alternatively, the elastic member 16*b* can be an air layer (sponge) having a layer thickness, that is, a gap between the metal core 16*a* and the fixing sleeve, of about 9 mm, for example.

Examples of materials and thicknesses of the layers in the fixing sleeve 16*c* are as follows: The base layer 161 can be a SUS steel having a thickness of 50 μm or smaller. The anti-oxidant layers 162 and 164 can be nickel strike coating having a layer thickness of 1 μm or smaller. The heat generation layer 163 can be a 15-μm copper coating. The elastic layer 165 can be a 150-μm silicone rubber layer. The release layer 166 can be a 30-μm layer of perfluoro alkoxy (PFA) polymer.

It is to be noted that the materials and the thicknesses of the layers in the fixing roller 16 are not limited to the examples described above.

In order to form a contact portion having a predetermined or given width between the pressure roller 17 and the fixing roller 16 with pressure from the pressure roller 17, the fixing roller 16 has an external diameter of about 40 mm, and the elastic member 16*b* has a thickness of within a range from 0.5 mm to 30 mm and a degree of hardness of within a range from 20° to 80° according to JIS K 6301 as an example. With this configuration, the fixing roller 16 can have a relatively small heat capacity and be heated quickly, reducing the warm-up time.

The pressure roller 17 is described below in further detail.

The pressure roller 17 includes a cylindrical metal core and an elastic member lying over the metal core as an example, although not shown in FIG. 1. The metal core can be formed with a metal such as copper and aluminum that has a relatively high thermal conductivity. Alternatively, a SUS steel can be used for the metal core. In the present embodiment, the pressure roller 17 can extend into an area of the fixing roller 16, that is, deform it slightly, by setting a hardness of the pressure roller 17 to a degree higher than that of the fixing roller 16. Then, the sheet 141 can curve along a circumferential surface of the pressure roller 17, which facilitate removal of the sheet 141 from the surface of the fixing roller 16. Although the pressure roller 17 has an external diameter of about 40 mm similarly to the fixing roller 16, the pressure roller 17 is thinner than the fixing roller 16 and has a thickness is of within a range from 0.3 mm to 20 mm. The pressure roller 17 is harder than the fixing roller 16 as described above and has a degree of hardness of within a range from 10° to 70° according to JIS K 6301, for example.

Induction heating and demagnetization in the fixer A8 are described below with reference to FIGS. 2A and 2B.

Figure 2B:
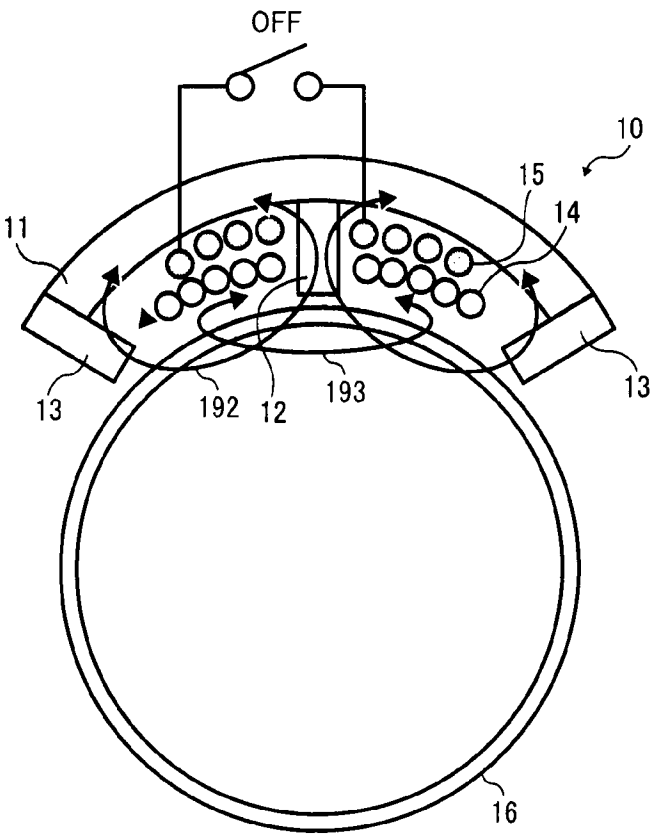
FIG. 2B illustrates demagnetization effects in the fixer shown in FIG. 1 when the demagnetization coils are off.
Figure 2A:
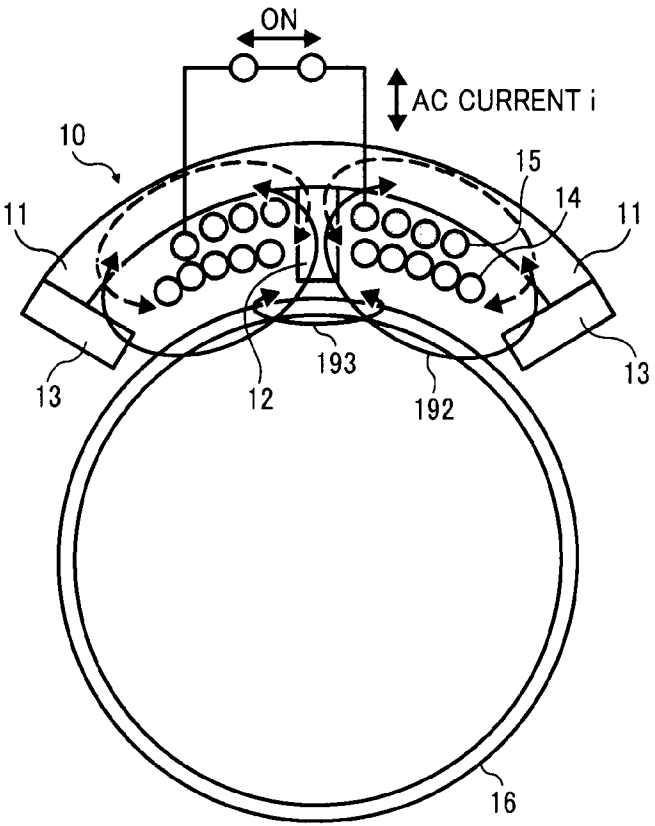

FIGS. 2A and 2B are end-on views in the axial direction and illustrate a demagnetization effect of the demagnetization coil units 15 when the demagnetization coil units 15 are shorted (on) and opened (off), respectively.

In FIGS. 2A and 2B, solid arc arrows 192 represent the inductive magnetic flux (excitation flux) generated by the excitation coil 14, solid arc arrows 193 represent the eddy current generated in the heat generation layer 163, arrows 194 indicate the direction perpendicular to a surface of the sheet 141 shown in FIG. 1, and dotted arc arrows represent demagnetizing flux generated by the demagnetization coil units 15.

As shown in FIG. 2B, when the demagnetization coil units 15 are opened (off), the excitation coil 14 generates the excitation flux, causing eddy current in the heat generation layer 163, and thus the heat generation layer 163 generates heat. In this state, as the demagnetization coil units 15 are off, the demagnetizing flux is not generated.

Subsequently, when the demagnetization coil units 15 are shorted or turned on as shown in FIG. 2A, the demagnetization coil units 15 generate the demagnetizing flux in the direction opposite that of the excitation flux generated by the excitation coil 14. As an inductive current thus flows in the demagnetization coil units 15 so as to counteract the excitation flux, generation of eddy current in the heat generation layer 163 can be inhibited. That is, heat generated by the heat generation layer 163 can be controlled by turning on and off the demagnetization coil units 15.

Here, a comparative example of a fixer is described below with reference to FIGS. 3A and 3B before describing features of the present embodiment.

Figure 3A:
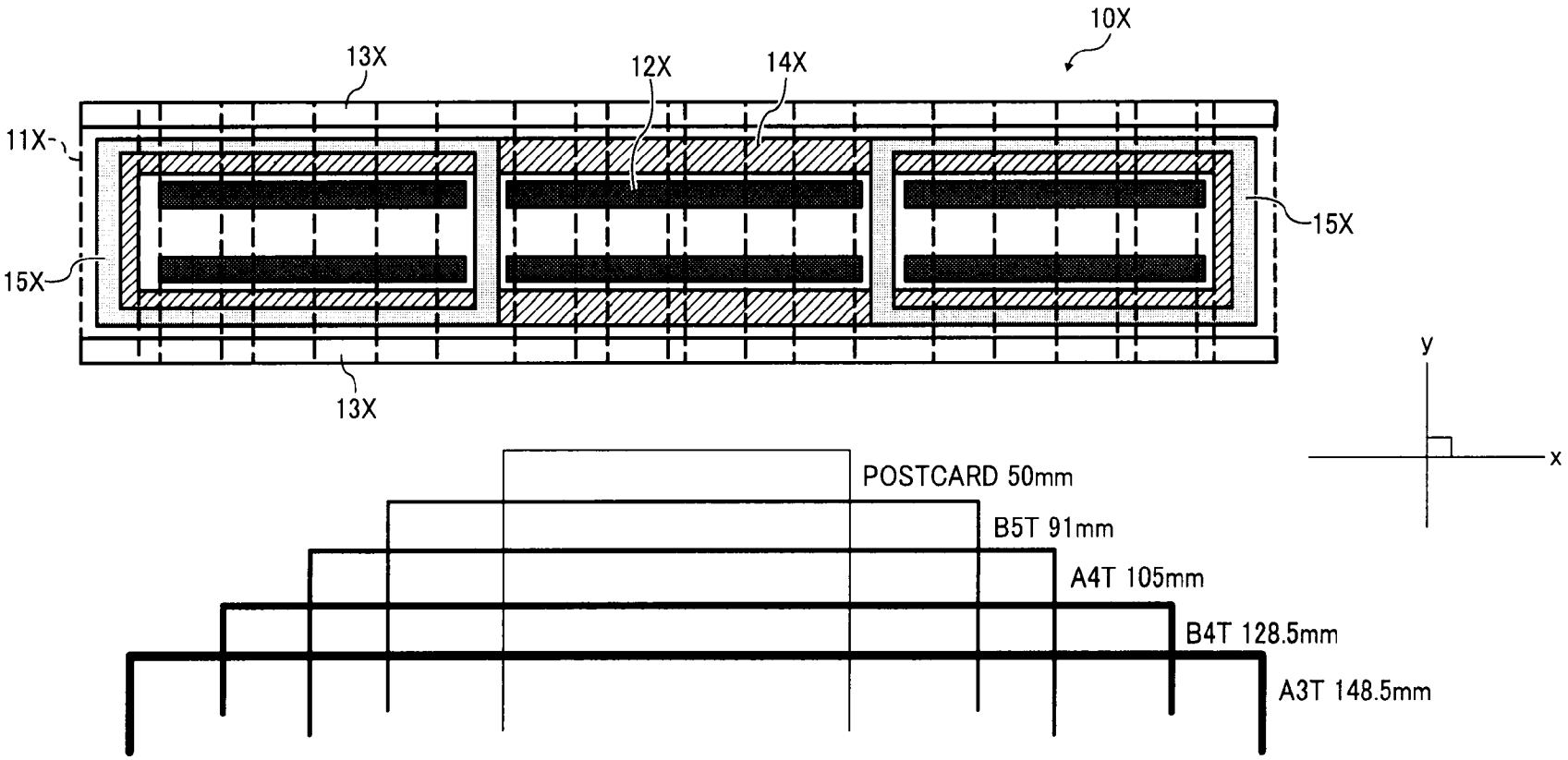
FIG. 3A illustrates an induction heating unit of a comparative fixer.

FIG. 3A illustrates an induction heating unit 10X of a comparative fixer viewed in the direction indicated by arrow 194 in FIG. 2, and sizes of sheets to be passed through the comparative fixer. In FIG. 3A, a vertical axis y and a horizontal axis x respectively indicate the sheet transport direction and the sheet width direction, reference characters "A3", "A4", and "A5" respectively represent standard sheet sizes, and "T" attached thereto means that those sheets are placed lengthwise. FIG. 3B is a graph showing temperature distribution in a fixing roller of the comparative fixer in the sheet width direction.

The comparative induction heating fixer has a configuration similar to that of the fixer A8 shown in FIG. 1 except the demagnetization coil. As shown in FIG. 3A, the induction heating unit 10X includes an arch core 11X, a center core unit 12X, side cores 13X, an excitation coil 14X that is looped so as to partly cover the fixing roller, and a demagnetization coil 15X shaped into a rectangular loop differently from the demagnetization coil unit 15 shown in FIG. 1.

More specifically, an outer edge portion of each demagnetization coil 15X in the sheet width direction overlaps an edge portion of the excitation coil 14X, and an inner edge portion thereof is perpendicular to the sheet width direction.

This comparative fixer has a relatively low heat capacity and can accommodate a limited number of standard sheet sizes. The comparative fixer adjusts a range (width) of the fixing roller to be heated by switching the demagnetization coil 15X between on and off when a particular standard size that in this example is postcard size is passed therethrough.

Figure 3B:
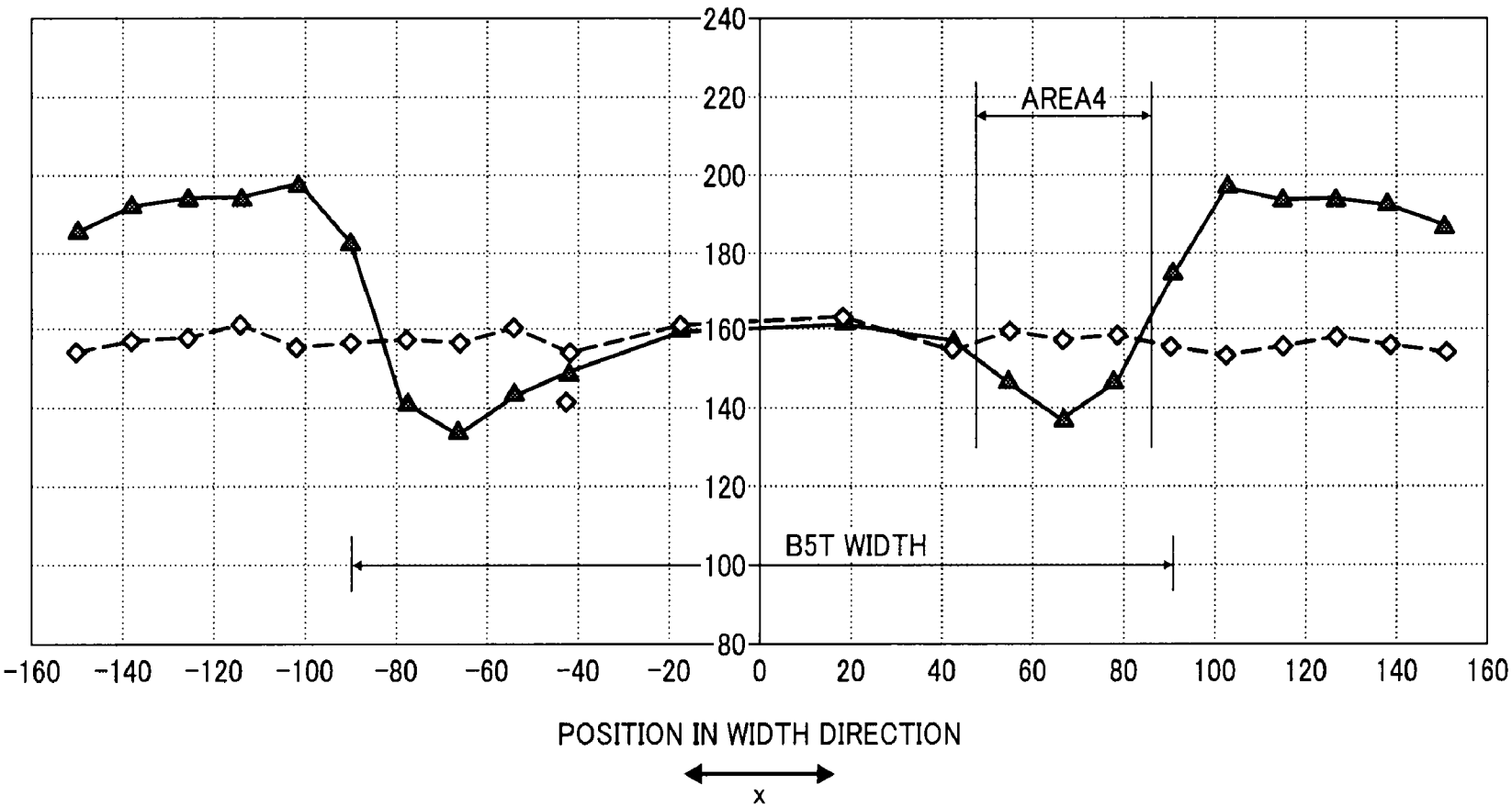
FIG. 3B is a graph illustrating temperature distribution in a fixing roller of the comparative fixer in a sheet width direction.

The temperature distribution shown in FIG. 3B is obtained when a sheet whose width is larger than that of postcard size, for example, a B5-sized sheet, passes lengthwise the comparative fixer. When the shape and the size of the demagnetization coil 15X are optimized for postcard size, that is, the demagnetization coil 15X extends outside an edge portion of postcard size as shown in FIG. 3A, fixing failure can occur when a sheet whose width is larger than that of postcard size, for example, a B5-sized sheet, is passed though the comparative fixer.

More specifically, when a B5-sized sheet is passed therethrough, the amount of the demagnetizing flux generated by the demagnetization coil 15X is adjusted to keep a highest temperature of a non-sheet area below a preferred temperature. Thus, the temperature tends to drop significantly in an edge portion of B5T size in the sheet width direction (hereinafter "partial drop or significant drop in temperature of fixing roller"). This edge portion is from about an edge of postcard size to about an edge of B5T size that is an area 4 shown in FIG. 3B. Such a decrease in temperature will cause fixing failure. Further, deviations in temperature of a surface of the fixing roller (fixing surface) can make gloss uneven between the edge portion and a center portion in the sheet width direction, resulting in a sub-standard image.

This is because the demagnetization coil 15X extends into the area 4 and accordingly inhibits heating therein, and simultaneously, the sheet passing the fixing nip deprives heat therefrom. The demagnetization coil 15X inhibits heating at an area outside the area 4 as well, and thus excessive heating at the non-sheet area can be prevented. By contrast, the demagnetization coil 15X does not affect the center portion inside the area 4 in the sheet width direction, and accordingly the center portion (sheet area) can be heated by the excitation coil 14X.

As described above, in the comparative fixer having the demagnetization coil 15X optimized for a particular small standard size (postcard size), the partial drop in temperature of the fixing roller is inevitable in the sheet area (area 4) due to effects of the demagnetization coil 15X when a sheet larger than the small standard size is passed through the fixer.

The above-described partial drop in temperature in the area 4 can cause a significant inconvenience in fixers whose heat capacity is relatively low because such fixers have a relatively small thermal conductive cross-sectional area, and accordingly thermal conductivity in an axial direction of a rotary member (fixing roller) is relatively small, that is, a heat equalization effect thereof is smaller. Further, because the demagnetization coil 15X is rectangular, the density of the demagnetizing flux can change abruptly in the sheet width direction. As a result, the excitation flux that acts on a heat generation layer of the fixing roller can change abruptly, causing a significant decrease in temperature. Thus, in the above-described fixer that is optimized for a particular small standard size, heat is insufficient in the end portion of the sheet, causing fixing failure in images formed on medium-sized sheets whose width is larger than that of the small standard size.

FIG. 3C is a table showing evaluation results of fixing failure and temperature rise at the non-sheet area that was obtained through an experiment in which sheets larger than the small standard size were passed through the comparative fixer shown in FIG. 3A.

As shown in FIG. 3C, when a B5T sheet and a A4T sheet were passed through the comparative fixer using the demagnetization coil 15X optimized for postcard size, fixing failure due to insufficient heat occurred, although excessive heating at the end portions was prevented. It is to be noted that when a B4T sheet and an A3T sheet were passed through the comparative fixer, the demagnetization coil 15X was not activated.

In view of the foregoing, features of the fixer A8 according to the present embodiment, shown in FIGS. 1 and 2, are described below.

Figure 4:
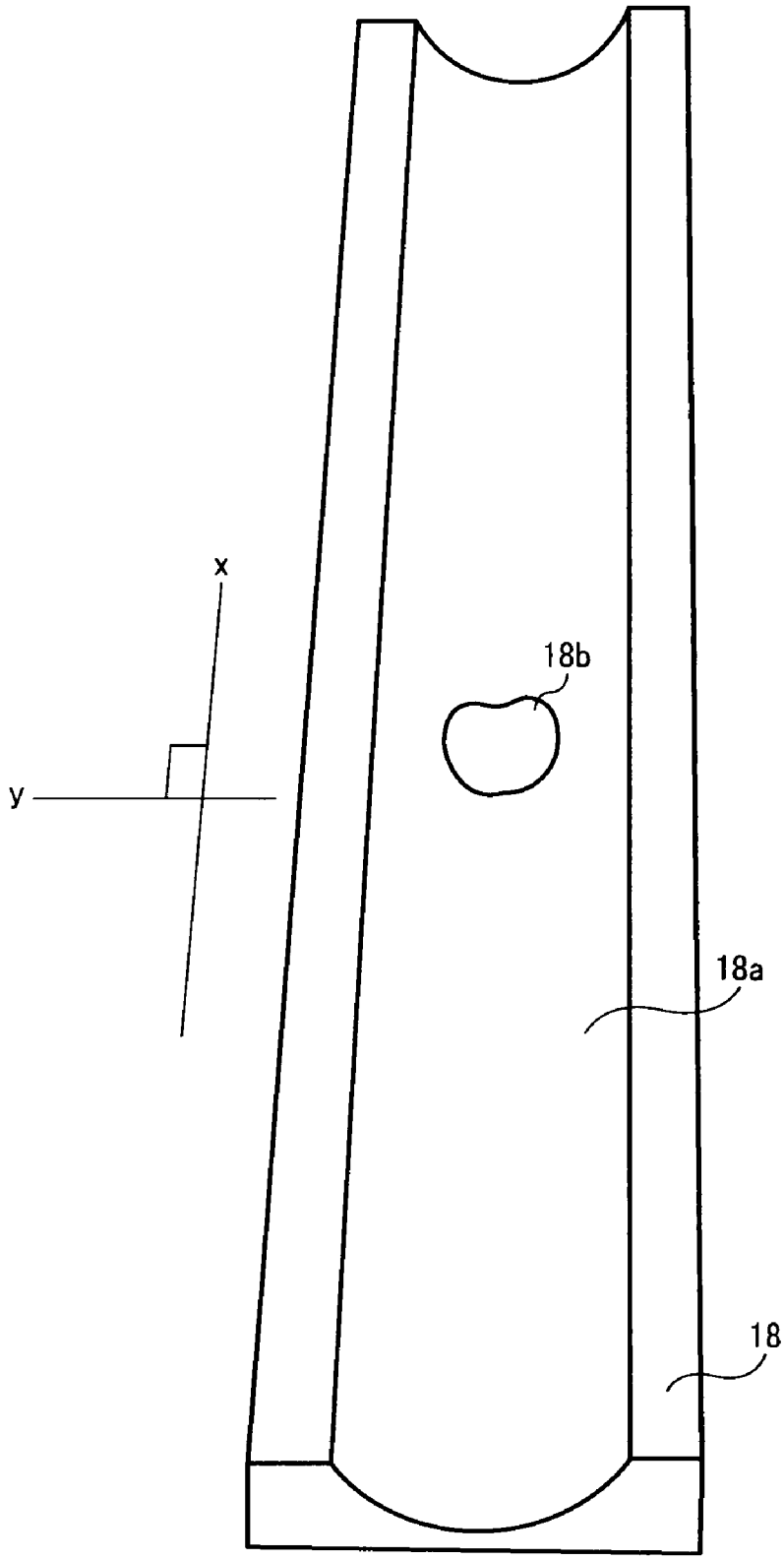
FIG. 4 is a perspective view illustrating a nonmagnetic resin frame supporting components included in an induction heating unit shown in FIG. 1 viewed from the side of a fixing roller.

FIG. 4 illustrates a nonmagnetic resin frame 18 that supports the respective cores (the arch core 11, the center core unit 12, and the side cores 13), the excitation coil 14, and the demagnetization coil units 15 of the induction heating unit 10 shown in FIG. 1. It is to be noted that FIG. 4 illustrates the resin frame 18 viewed from the side of the fixing roller 16.

As shown in FIG. 4, the resin frame 18 includes a curved surface 18*a* facing the fixing roller 16 shown in FIG. 1 and a hole 18*b* provided in a center portion in the sheet width direction. The curved surface 18*a* partly covers an external circumference of the fixing roller 16 shown in FIG. 1 and recessed toward an outer side (back surface) in the diametral direction of the fixing roller 16. The respective cores, the excitation coil 14, and the demagnetization coil units 15 are provided on a back of the curved surface 18*a*. Thus, the respective cores, the excitation coil 14, and the demagnetization coil units 15 can be held close to the heat generation layer 163 of the fixing roller 16 relatively easily, attaining reliable induction heating. Simultaneously, accuracy in assembly can be enhanced because the respective cores, the excitation coil 14, and the demagnetization coil units 15 can be integrated into a single unit.

In the hole 18*b*, a temperature detector is provided for detecting a surface temperature of the fixing roller 16.

Figure 5:
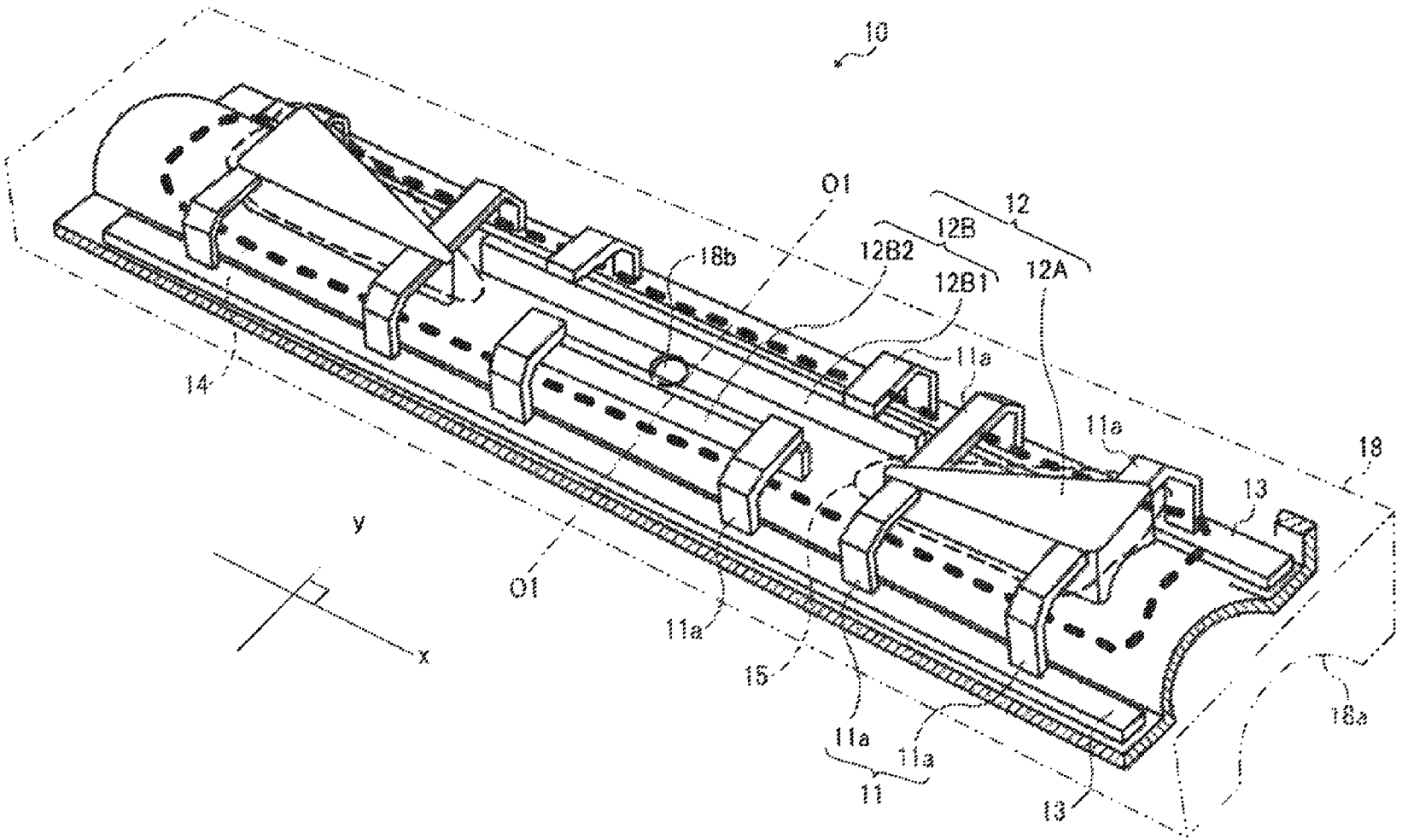
FIG. 5 is a perspective view illustrating the nonmagnetic resin frame that is reversed from the state shown in FIG. 4.

FIG. 5 illustrates an example of a configuration of the induction heating unit 10, in which the resin frame 18 is reversed from the state shown in FIG. 4, showing the back surface. It is to be noted that, in FIG. 5, the excitation coil 14 and the demagnetization coil units 15 are respectively shown as a bold dotted-line and thinner dotted-lines for simplicity.

As described above, the respective cores, the excitation coil 14, and the demagnetization coil units 15 are provided on the back surface of the resin frame 18. The back surface of the resin frame 18 includes a convexly curved portion. The side cores 13 that are shaped like long pallets extending in the sheet width direction (x axis) are fixed to bottom portions on both sides of the convex curve portion, respectively.

The center core unit 12 includes two differently shaped cores, the center cores 12A and 12B (12B1 and 12B2) that are fixed to an apex portion of the convex curve portion and arranged in the sheet width direction. The center cores 12A are shaped into substantially right-triangular poles and stand on the apex portion of the convex curve portion of the resin frame 18 in both end portions in the sheet width direction. Each of the center cores 12B1 and 12B2 extends in the sheet width direction (y axis), and the center core 12B1 parallels or substantially parallels the center core 12B2 that is shorter than the center core 12B1.

In the example shown in FIG. 5, the arch core 11 includes multiple cores 11*a* disposed at given intervals in the sheet width direction. Each core 11*a* is shaped like a curved plate standing on the side cores 13 and curving in the sheet transport direction along the convexly curved portion, and connects to either the center core 12A or 12B as well as the side core 13. Alternatively, the arch core 11 can be a single unit connecting the side cores 13 that are disposed on both sides of the center core unit 12 as shown in FIGS. 1 and 2. In the example shown in FIG. 5, because the cores 11*a* on both sides of the center core 12A or 12B are separated and can be arranged more flexibly in the sheet transport direction. In other words, this configuration can be more suitable to prevent temperature unevenness with a minimum amount of the arch core 11.

Additionally, the configuration of the arch core 11 is not limited to the examples shown in FIGS. 1 and 5.

It is to be noted that, in the example shown in FIG. 5, the center cores 12A, 12B1, and 12B2, the cores 11*a* of the arch core 11, and the side cores 13 are arranged symmetrically with respect to a center line (axis of symmetry) O1-O1 that parallels the sheet transport direction (y axis) across a center portion of the resin frame 18 in the sheet width direction (x axis), and reference characters are given only to the components on one side thereof for simplicity.

As shown in FIG. 5, the excitation coil 14 is disposed in a narrow area enclosed by the cores 11*a*, the side cores 13, the resin frame 18, and one of the center cores 12A, 12B1, and 12B2 and contacts or is close to the surface of the curved buck surface of the resin frame 18. The excitation coil 14 forms a substantially rectangular loop like a flat ribbon. The induction heating unit 10 further includes a driving source that is connected to both ends of winding wire of the excitation coil 14 via a switch.

Each demagnetization coil unit 15 is disposed in a narrow area enclosed by the center core 12A, the cores 11*a*, the side cores 13, and the resin frame 18, and forms a substantially triangular loop looped outside the center core 12A. It is to be noted that each demagnetization coil unit 15 overlaps the excitation coil 14 in a direction perpendicular to a surface xy shown in FIG. 5.

Figure 6A:
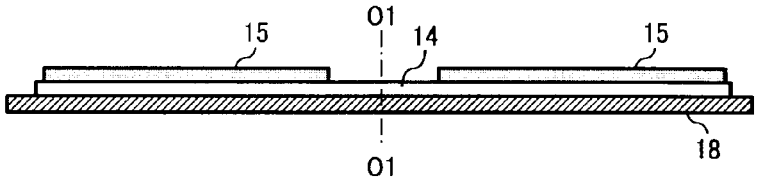
FIG. 6A schematically illustrates a main part of the induction heating unit shown in FIG. 5 viewed in a sheet transport direction.
Figure 6B:
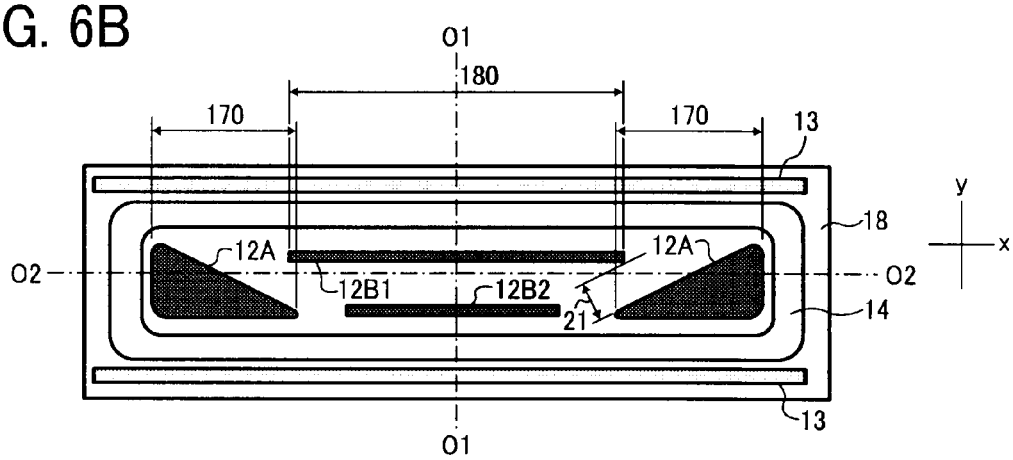
FIGS. 6B, 6C, and 6D respectively illustrate components of the induction heating unit shown in FIG. 5 that are projected on a tangent plane of a heat generation layer facing the induction heating unit.
Figure 6C:
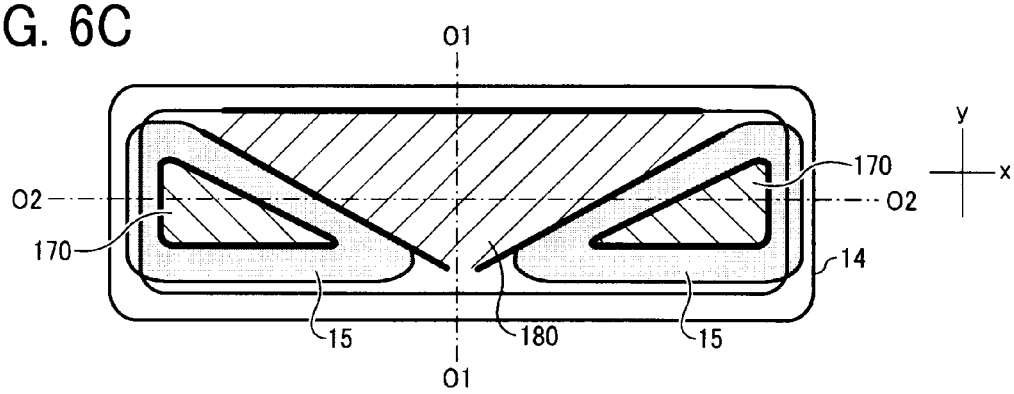
Figure 6D:
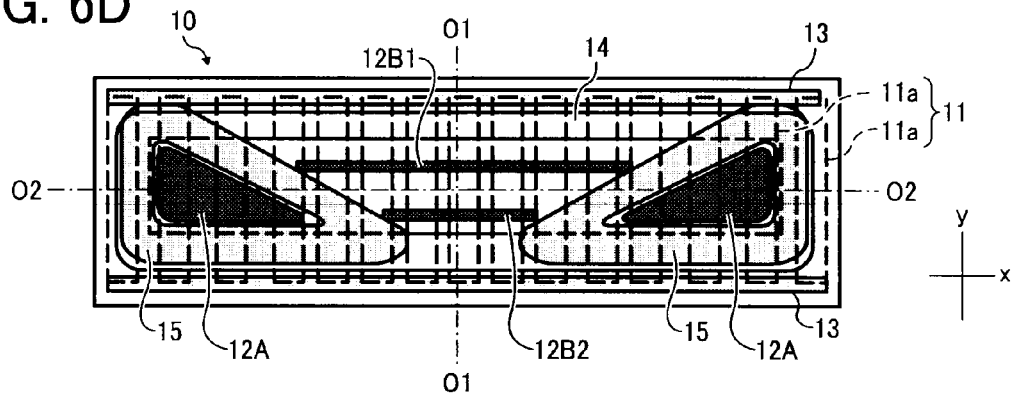

FIG. 6A schematically illustrates a main part of the induction heating unit 10 viewed in the sheet transport direction, which is perpendicular to the sheet width direction. In FIG. 6A, the demagnetization coil units 15 are partly superimposed on the excitation coil 14. FIGS. 6B, 6C, and 6D illustrate a center line O2-O2 of a rotary shaft (hereinafter "rotary axis line") of the fixing roller 16, the excitation coil 14, the demagnetization coil units 15, the respective cores that are projected on a tangent plane of the curved heat generation layer 163.

When the excitation coil 14, the demagnetization coil units 15, and the rotary axis of the fixing sleeve 16*c* are projected on the tangent plane of the heat generation layer 163 facing the excitation coil 14 and the demagnetization coil units 15, the axis of symmetry O1-O1 shown in FIG. 5 is in a center portion of the tangent plane in the rotary axial direction of the fixing sleeve 16*c* (sheet width direction) and is perpendicular to the rotary axial direction. In other words, the axis of symmetry O1-O1 parallels the sheet transport direction (y axis).

This tangent plane is described below in further detail.

Referring to FIG. 1, the line N1-N1 is the tangent line of the fixing sleeve 16*c* at an intersection point with the line L1-L1 that connects the centers O2 and O3. A virtual plane including the tangent line N1-N1 of the fixing sleeve 16*c* that is perpendicular to the surface of the paper on which FIG. 1 is drawn is considered as a tangent plane of the curved heat generation layer 163 facing the excitation coil 14 and the demagnetization coil units 15 (hereinafter "tangent plane H"). A surface of the sheet on which FIGS. 6B through 6D are drawn serves as this tangent plane H. In other words, FIGS. 6B through 6D illustrate the induction heating unit 10 viewed from the side opposite the fixing roller 16 shown in FIG. 1, that is, in a direction perpendicular to the surface of the sheet on which FIG. 1 is drawn.

As shown in FIG. 6B, the demagnetization coil units 15 are looped around the respective center cores 12A that are symmetrical with respect to the symmetric axis O1-O1. Both the demagnetization coil units 15 disposed symmetrically are connected via a conductive wire, forming an electrical current path, and the two ends of the demagnetization coil can be opened and closed (disconnected and connected) using the switch.

Arrangement of the center cores 12A and 12B is described below in further detail with reference to FIGS. 6A, 6B, 6C, and 6D.

It is to be noted that the components of the induction heating unit 10 are separately shown in FIGS. 6B and 6C for simplicity. More specifically, FIG. 6B illustrates the excitation coil 14, the respective cores, and the resin frame 18, and FIG. 6C illustrates only the excitation coil 14 and the demagnetization coil units 15. FIG. 6D illustrates the demagnetization coil units 15 and the arch core 11 in addition to the components shown in FIG. 6B, and the core 11 includes multiple cores 11*a* disposed at intervals in the sheet width direction (x axis) so as to attain preferred heat generation. Alternatively, the arch core 11 can be a single unit connecting the side cores 13 and the center core unit 12 as shown in FIG. 1.

If an area enclosed by both the excitation coil 14 and the demagnetization coil unit 15 constitutes a first area 170, and an area enclosed by the excitation coil 14 outside the enclosures of the demagnetization coil units 15 constitutes a second area 180 as shown in FIG. 6C, then the center cores 12A and 12B (12B1 and 12B2) are respectively disposed in the first area 170 and the second area 180 as shown in FIG. 6D. In FIG. 6B, reference numeral 21 represents a gap between an oblique side of the center core 12A and the center core 12B1.

Thus, hereinafter the center cores 12A and 12B are referred to as a first magnetic core and a second magnetic core, respectively. A feature of the present embodiment is that the first magnetic core (center core 12A) and at least one of the second magnetic cores (center core 12B1 and 12B2) are continuous in the sheet width direction (x axis), that is, the rotary axial direction of the fixing sleeve 16 serving as the rotary heat generator, as viewed from the sheet transport direction.

The center cores 12A and 12B are thus distinguished from each other for the following reason: Each center core 12A is enclosed by both the excitation coil 14 and thus can be shared by the excitation coil 14 and the demagnetization coil unit 15. By contrast, the center cores 12B1 and 12B2 are enclosed by only the excitation coil 14 and thus can be dedicated to the excitation coil 14.

The feature described above means that, although the first magnetic core (center core 12A) and the second magnetic core (center core 12B1 and 12B2) are physically separated, they are continuous in the sheet width direction as viewed from the sheet transport direction. In other words, at least one of the center cores 12A, 12B1, and 12B2 is present in any cross section of the fixer A8 perpendicular to the sheet width direction, with the center cores overlapping with each other so as to look like a single continuous line when viewed from the sheet transport direction.

Just as importantly, as noted above, if the center core 12 is partly absent in the sheet width direction, the density of the magnetic flux generated by the excitation coil 14 will be lower in a portion where the center core 12 is absent, which causes the temperature to decrease. Therefore, in the present embodiment, the center core is present in any cross section of the fixer A8 in a direction perpendicular to the sheet width direction in order to prevent or reduce a decrease in temperature. This configuration can prevent or reduce counteraction of the magnetic flux generated by portions of the coil disposed on both sides of the center core in the sheet transport direction as well as dispersion of the magnetic flux.

However, it is to be noted that, even if the center core is absent in a given cross section of the fixer A8 in the direction perpendicular to the sheet width direction, that is, if there is a gap between the physically separate center cores in the sheet width direction, such cores can be magnetically connected sufficiently to guide the magnetic flux efficiently to the heat generation layer 163 as long as the gap is sufficiently short, for example, less than 1 mm, and thus the flux density of the magnetic flux generated by the excitation coil 14 does not decrease abruptly. Thus, such a configuration, in which the cores are not physically continuous but only magnetically continuous, can be within the definition "center cores are continuous in the sheet width direction".

In other words, even if the demagnetization coil unit 15 separates the area enclosed by the excitation coil 14 in the sheet width direction, when an oblique side of the demagnetization coil unit 15 looped like a triangle, which does not overlap the excitation coil 14 in the direction perpendicular to the surface xy, is obliquely to the sheet transport direction, the center cores can be disposed continuously in the sheet width direction relatively easily. As a result, when the excitation coil 14 is activated, abrupt fluctuations in the magnetic flux density can be prevented or reduced in whole the area enclosed by the excitation coil 14, and thus the heat generation layer 163 facing the excitation coil 14 can heat without uniformly.

As described above, when the center cores 12A, 12B1, and the 12B2 are disposed continuously in the sheet width direction, the demagnetization coil unit 15 should be looped so as to have a portion oblique to the sheet transport direction such as the oblique side of the substantially right-triangular loop shown in FIG. 6D.

More specifically, on the tangent plane H described above, by disposing the demagnetization coil unit 15 so that the portion of the loop oblique to the sheet transport direction crosses an edge portion in the sheet width direction of the sheet passing through the fixer A8, a partial decrease (unevenness) in temperature of the fixing roller 16 can be prevented or reduced.

Further, compared to the demagnetization coil 15X of the comparative fixer shown in FIG. 3A that does not include such an oblique portion to the sheet transport direction, abrupt fluctuations in the magnetic flux density in the end portions in the width direction can be better prevented or reduced, and thus temperature unevenness between the center portion and the end portions as well as unevenness in gloss of the resultant image can be better prevented or reduced.

It is to be noted that, in the present embodiment, the center cores 12A have a shape similar to that of the demagnetization coil unit 15 as shown in FIG. 6D so as to increase the density of the magnetic flux that acts on the heat generation layer 163, enhancing heat generation efficiency. Additionally, with this configuration, the center cores 12A and 12B can be continuously arranged relatively easily. Therefore, although it is preferable that the center cores 12A have a shape identical or substantially identical to that of the demagnetization coil 15, the shape of the center cores 12A is not limited thereto and can be any shape as long as the center cores 12A and 12B can be arranged continuously in the sheet width direction.

Next, relations between the arrangement of the center cores and magnetic flux density are described below in further detail.

The magnetic flux density in examples 1 and 2 in which the center cores are continuous and are not continuous in the sheet width direction, respectively, as well as a theory of a decrease in temperature are described below with reference to FIGS. 7A, 7B, and 7C.

EXAMPLE 1

Figure 7A:
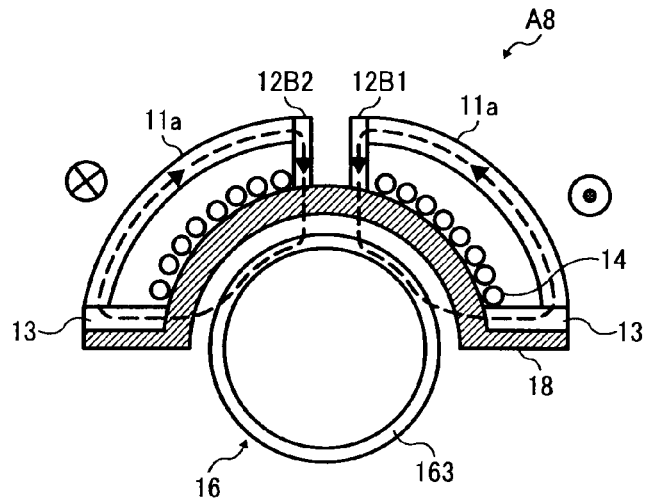
FIG. 7A is an end-on view illustrating a cross section of a center portion of the fixer shown in FIG. 1.
Figure 7B:
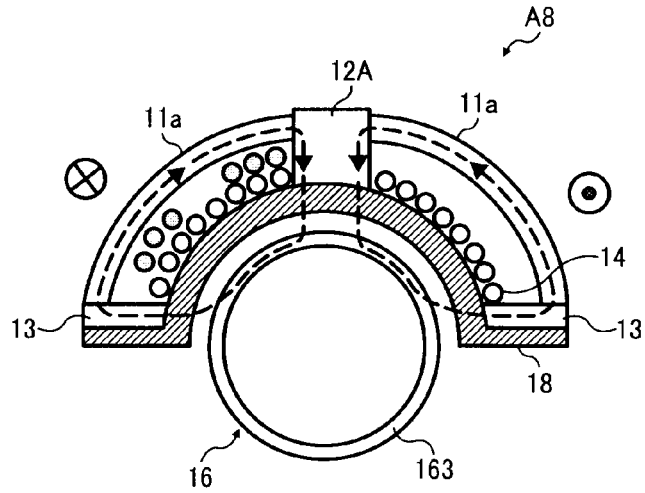
FIG. 7B is an end-on view illustrating a cross section of an end portion of the fixer shown in FIG. 1.

FIGS. 7A and 7B respectively illustrates a cross section of the center portion along the line O1-O1 shown in FIG. 6D and the end portion of the fixer A8 in the sheet width direction. That is, the center cores 12B1 and 12B2 are present in FIG. 7A, and the center core 12A is present in FIG. 7B.

In example 1, the center cores are continuous in the sheet width direction as shown in FIG. 6D. When the demagnetization coil units 15 are open and the excitation coil 14 is energized in the fixer A8, a counterclockwise magnetic field running through the side core 13, the arch core 11 (cores 11*a*), the center core 12B1, and the heat generation layer 163 is formed in a right portion in FIG. 7A. Simultaneously, a clockwise magnetic field running through the side core 13, the arch core 11 (cores 11*a*), the center core 12B2, and the heat generation layer 163 is formed in a left portion in FIG. 7A. Thus, the heat generation layer 163 can generate heat in the center portion.

Referring to FIG. 7B, in this state, a counterclockwise magnetic field and a clockwise magnetic field are generated in the end portion of the fixer A8 as well. More specifically, the counterclockwise magnetic field running through the side core 13, the arch core 11 (cores 11*a*), the center core 12A, and the heat generation layer 163; and the clockwise magnetic field running through the side core 13, the arch core 11 (cores 11*a*), the center core 12A, and the heat generation layer 163 are formed in a right portion and a left portion in FIG. 7B, respectively. Thus, the heat generation layer 163 can generate heat in the end portion in the sheet width direction as well.

As described above, the magnetic flux can be guided to the heat generation layer 163 efficiently when the center cores are continuous in the sheet width direction as in the present embodiment.

EXAMPLE 2

By contrast, it is assumed that the center core is absent in boundary areas between the first areas 170 and the second area 180 shown in FIG. 6B in example 2. This is described below using the comparative fixer shown in FIG. 3A.

Figure 7C:
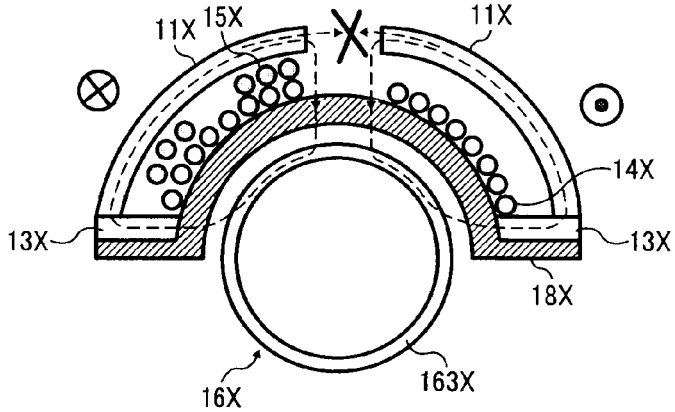
FIG. 7C is an end-on view illustrating a cross section of a comparative fixer in which center cores are not continuous in the sheet width direction.

FIG. 7C illustrates a cross section of such a boundary area of the comparative fixer where the center core is absent.

Even when the demagnetization coils 15X are open and the excitation coil 14X is energized in the comparative fixer, a counterclockwise magnetic field and a clockwise magnetic field are not generated in the boundary areas as shown in FIG. 7C because the center core 12X is absent in the boundary area. In this configuration, the magnetic flux generated by portions of the excitation coil 14X disposed on both sides in the sheet transport direction can counteract each other and/or the magnetic flux can disperse, decreasing the magnetic flux density. As a result, the magnetic flux density in the comparative fixer is lower than that in the fixer A8 shown in FIGS. 7A and 7B according to the present embodiment.

Features of the demagnetization coil units 15 are described below.

1. As described above, the demagnetization coil units 15 on the tangent plane H, that is, the surface of the paper on which FIG. 6D is drawn, has the portion oblique to the sheet width direction or the sheet transport direction. This portion is the oblique side of the substantially right-triangular loop in FIG. 6D. Further, the demagnetization coil unit 15 is disposed so that the oblique portion crosses an edge portion in the sheet width direction of the sheet passing through the fixer A8. Thus, effects of the demagnetizing flux counteracting the magnetic flux generated by the excitation coil 14 can increase from the center portion to the edge portion in the sheet width direction as the triangular area enclosed by the demagnetization coil unit 15 becomes larger in that direction.

With this configuration, the effects of the demagnetizing flux counteracting the magnetic flux generated by the excitation coil 14 can increase from the axis of symmetry O1-O1 shown in FIG. 6D toward edges in the non-sheet areas in the sheet width direction. When the fixer A8 is optimized for postcard size, the non-sheet areas are areas of the fixing roller 16 where postcards do not pass but sheets larger than postcards pass. Accordingly, heat generated by the heat generation layer 163 decreases toward the edge of the triangular area gradually in the sheet width direction. Thus, by setting the size and the shape of the demagnetization coil unit 15 so that an edge of a B5T sheet, for example, is in the triangular area, a significant decrease in temperature in the end portions in the sheet width direction described with reference to FIG. 3B can be prevented even when a B5T sheet passes through the fixer A8. Additionally, when a maximum sheet usable in the fixer A8 (hereinafter "maximum usable sheet") is fixed, good fixing quality can be obtained by deactivating the demagnetization coils 15.

2. Referring to FIG. 6C, when the rotary axis line O2-O2 on the tangent plane H (surface of the paper on which FIGS. 6C is drawn) is regarded as an axis of symmetry, it can be defined that the portion of the looped demagnetization coil unit 15 that crosses the sheet width direction (oblique side of the substantially right-triangular loop) is linear and asymmetrical with respect to the rotary axis line O2-O2.

3. The fixer A8 according to the present embodiment can accommodate at least three different sheet widths. The size and the shape of the demagnetization coil unit 15 can be determined so that the portion thereof oblique to the sheet transport direction on the tangent plane H can cross an edge portion in the width direction of any sheet size between a minimum sheet usable in the fixer A8, such as postcard size, and the maximum usable sheet, such as A3T size (hereinafter "medium sheet size").

It is to be noted that a preferred fixing temperature can be attained by deactivating the demagnetization coil units 15 when the maximum usable sheet passes the fixer A8, and the fixer A8 is optimized for the minimum usable sheet. Therefore, the demagnetization coil unit 15 is configured so that the oblique portion does not cross an area covered by only the maximum usable sheet and an area covered by only the minimum usable sheet.

Thus, by increasing a force to counteract the excitation flux toward outside in the width direction, excessive heating at the end portions in the non-sheet areas of the fixing roller 16 can be prevented or reduced. Simultaneously, a significant decrease in fixing temperature in the medium sheet sizes can be prevented or reduced, and thus fixing failure and/or unevenness in gloss can be prevented or reduced.

Figure 8:
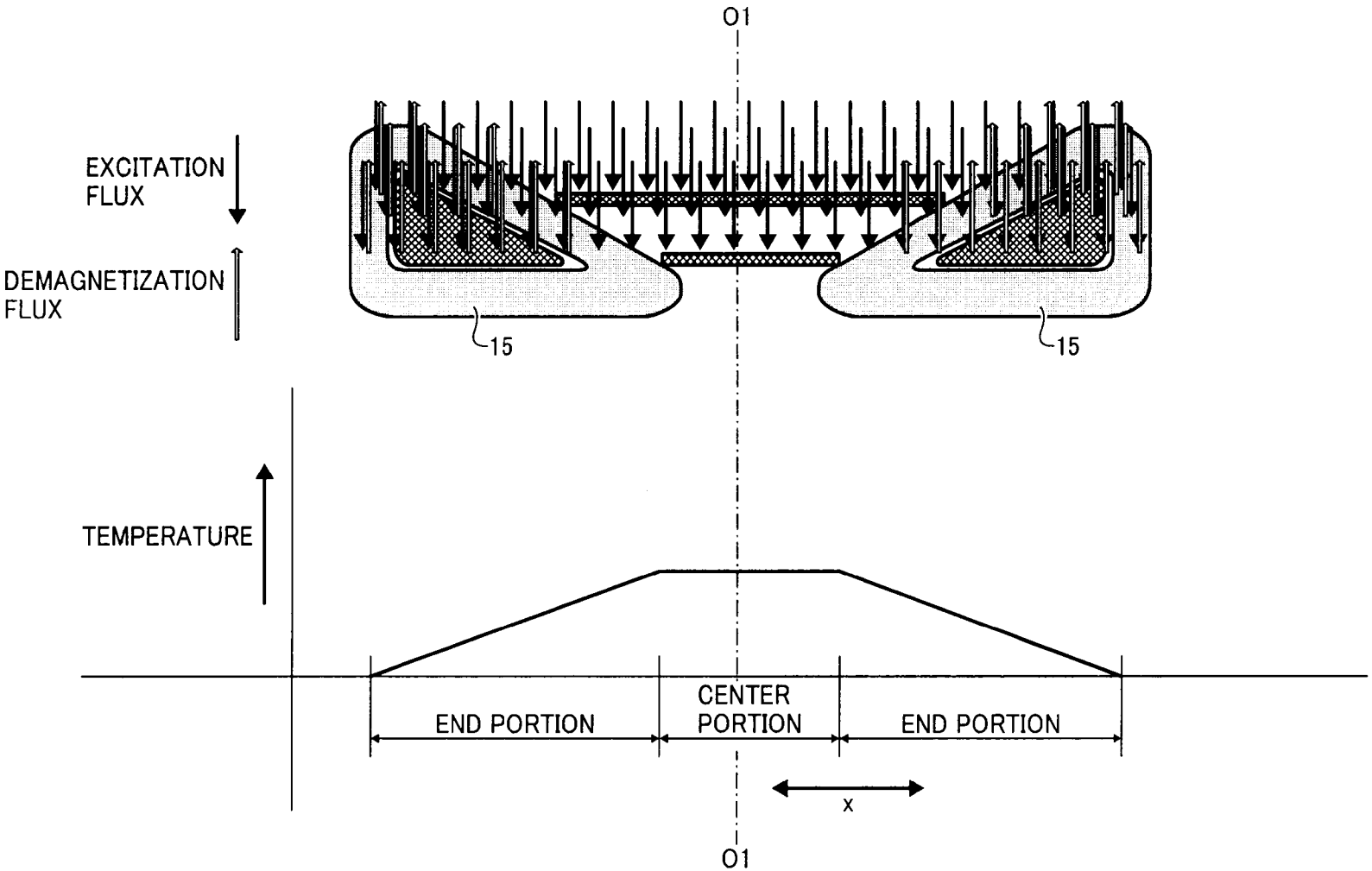
FIG. 8 illustrates a state in which excitation flux in the sheet width direction is demagnetized obliquely.

FIG. 8 illustrates that the excitation flux in the sheet width direction when the demagnetization coil units 15 are activated.

As shown in FIG. 8, by demagnetizing the excitation flux obliquely using the demagnetization coil units 15 having the above-described features, the excitation flux decreases gradually from the center portion, that is, the axis of symmetry O1-O1, toward outside the triangular area in the width direction indicated by arrow x. Fixing quality in the end portions in the sheet width direction indicated by arrow x can be better controlled by decreasing the density of the excitation flux gradually in that direction, although the demagnetization effect should be further adjusted by controlling duty of energization of the demagnetization coil units 15 in practice.

In the comparative fixer shown in FIGS. 3A and 3B, because the portion of the demagnetization coil 15X corresponding to the edge portion of the sheet parallels the sheet transport direction, the demagnetization coil 15X can accommodate only a single sheet size, that is, postcard size in FIGS. 3A and 3B. Further, a significant drop in temperature in the area 4 shown in FIG. 3B is caused because the portion of the demagnetization coil 15X corresponding to the edge portion of the sheet is perpendicular to the sheet width direction, that is, the demagnetization coil 15X can accommodate only a single sheet size.

By contrast, when the demagnetization coil units 15 have the shape described above, the area of the sheet that crosses the oblique side of the demagnetization coil unit 15 can be broader. In other words, the demagnetization effect on the edge portions of the sheet can be broader as well as gradual. Therefore, the significant drop in temperature of fixing roller can be prevented or reduced.

Here, a theory about how the demagnetizing flux is increased toward the edge portion in the sheet width direction using the demagnetization coil units 15 is described below with reference to FIG. 9.

Figure 9:
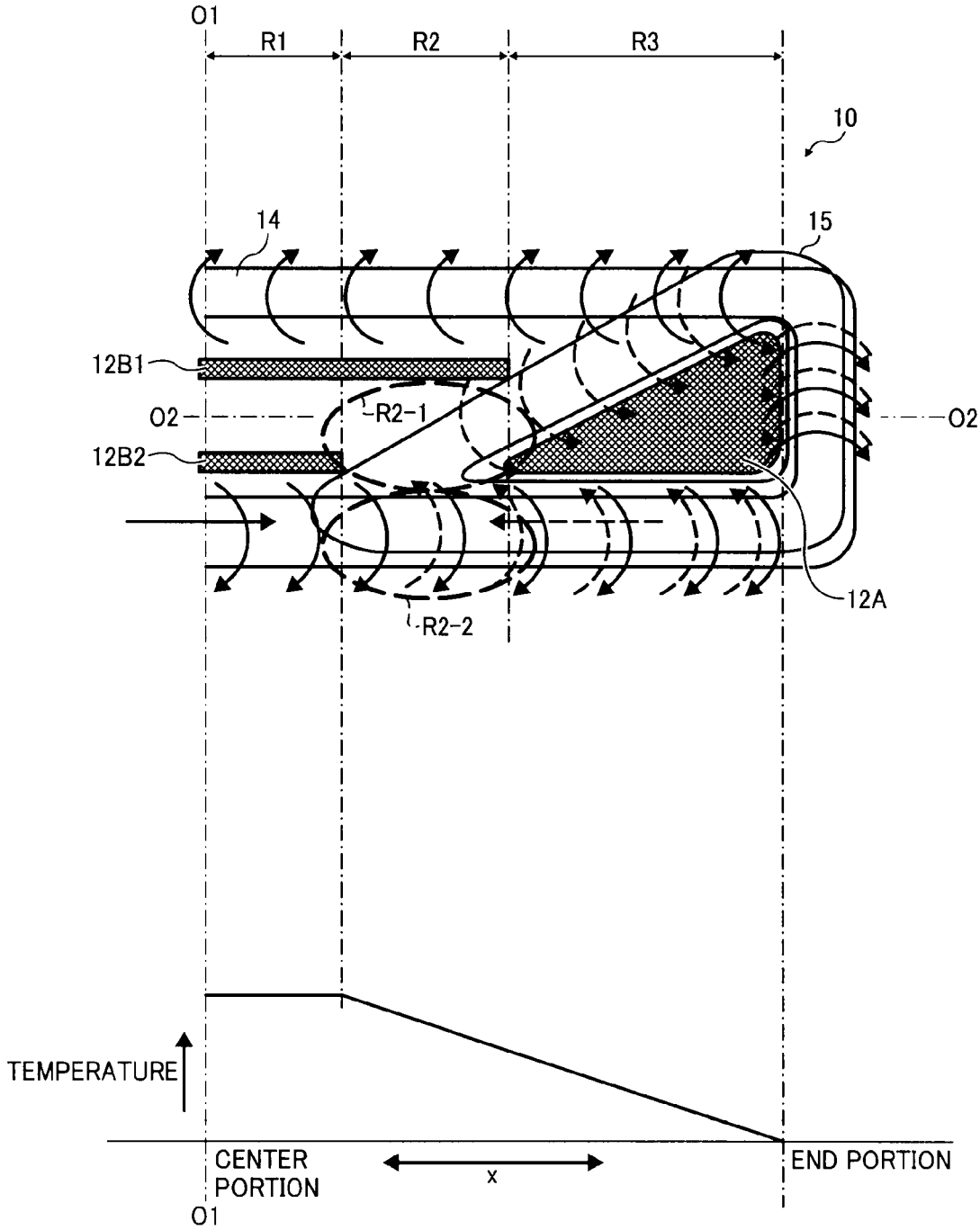
FIG. 9 illustrates demagnetization effects of the demagnetization coils shown in FIG. 5 and changes in temperature of the fixing roller caused by the demagnetization effects.

In FIG. 9, a half portion of the induction heating unit 10 projected on the tangent plane H is shown in an upper portion, and a graph showing changes in temperature of the fixing roller 16 caused by the demagnetization effect is shown in a lower portion. In FIG. 9, solid arrows and dotted arrows represent the magnetic flux generated by the excitation coil 14 (excitation flux) and that generated by the demagnetization coil units 15 (demagnetizing flux), respectively.

In an area R1, the excitation flux is not counteracted by the demagnetizing flux because the demagnetization coil unit 15 is not present in the area R1. Accordingly, the demagnetizing flux does not act on upper portion and lower portion of the excitation coil 14 respectively located above and beneath the rotary axis line O2-O2 in FIG. 9 in principle.

By contrast, in an area R2, it is difficult to described clearly how the density of the magnetic flux is distributed and how the magnetic flux acts. In an area R2-2 where the portion of the excitation coil 14 located beneath the rotary axis line O2-O2 in FIG. 9 is overlapped by the demagnetization coil 15, the magnetic flux generated by the excitation coil 14 can be counteracted by the demagnetizing flux. By contrast, in an area R2-1, the demagnetization coil unit 15 is not overlapped by the excitation coil 14 and generates magnetic flux in a direction to increase the magnetic flux generated by the excitation coil 14 indicated by solid arrows. Therefore, even if the demagnetization coil unit 15 is energized so as to cancel the excitation flux, the excitation flux is not cancelled completely in the area R2-1 due to the magnetic flux generated by the demagnetization coil 15.

Regarding a portion above the rotary axis line O2-O2 in the area R2, the magnetic flux generated in the areas R2-1 and R2-2 does not acts on an upper portion of the excitation coil 14 because the center core 12B1 is present.

Thus, in the area R2, the excitation flux generated by the lower portion of the excitation coil 14 is cancelled to some extent although not completely, and the excitation flux generated by the upper portion thereof is not cancelled.

In an area R3, the excitation flux generated by a lower portion of the excitation coil 14 is cancelled by the demagnetizing flux generated by the demagnetization coil unit 15 overlapping the excitation coil 14. Regarding the excitation flux generated by an upper portion of the excitation coil 14, the demagnetization effect has close relations with a distance between the excitation coil 14 and the demagnetization coil 15. More specifically, the shorter the distance between the excitation coil 14 and the demagnetization coil unit 15 is, the stronger the interaction between the excitation flux and the demagnetizing flux is, and thus the demagnetization effect increases toward the edge potion in the width direction. As a result, inhibition of temperature rise becomes stronger toward the edge portion in the sheet width direction indicated by arrow x as shown in the graph shown the graph in FIG. 9.

As described above, in the area R3, because the demagnetizing flux counteracts on the portions of the excitation coil 14 disposed on both sides of the rotary axis line O2-O2, the demagnetization effect are larger than that in the area R2. Thus, the demagnetization effect increases in the areas R1, R2, and R3 in that order.

It is to be noted that, although the magnetic flux density seems to change like an oblique line, the magnetic flux density can be adjusted by monitoring the changes in temperature in practice because it is difficult to actually measure the magnetic flux density. It can be considered that the magnetic flux density changes like an oblique line from facts that the resultant changes in temperature form an oblique line and that fixing performance is enhanced.

Descriptions will be given below of other embodiments of the present invention in which the configuration of the first magnetic core is different from that of the embodiment shown in FIGS. 5 though 9 and which can be divided into multiple cores each shaped into a parallelogram or trapezium pole or a substantially parallelogram or trapezium pole.

An illustrative embodiment in which the first magnetic core is divided into multiple cores each shaped like a parallelogram or a triangle is described below with reference to FIGS. 10 through 13.

Figure 10:
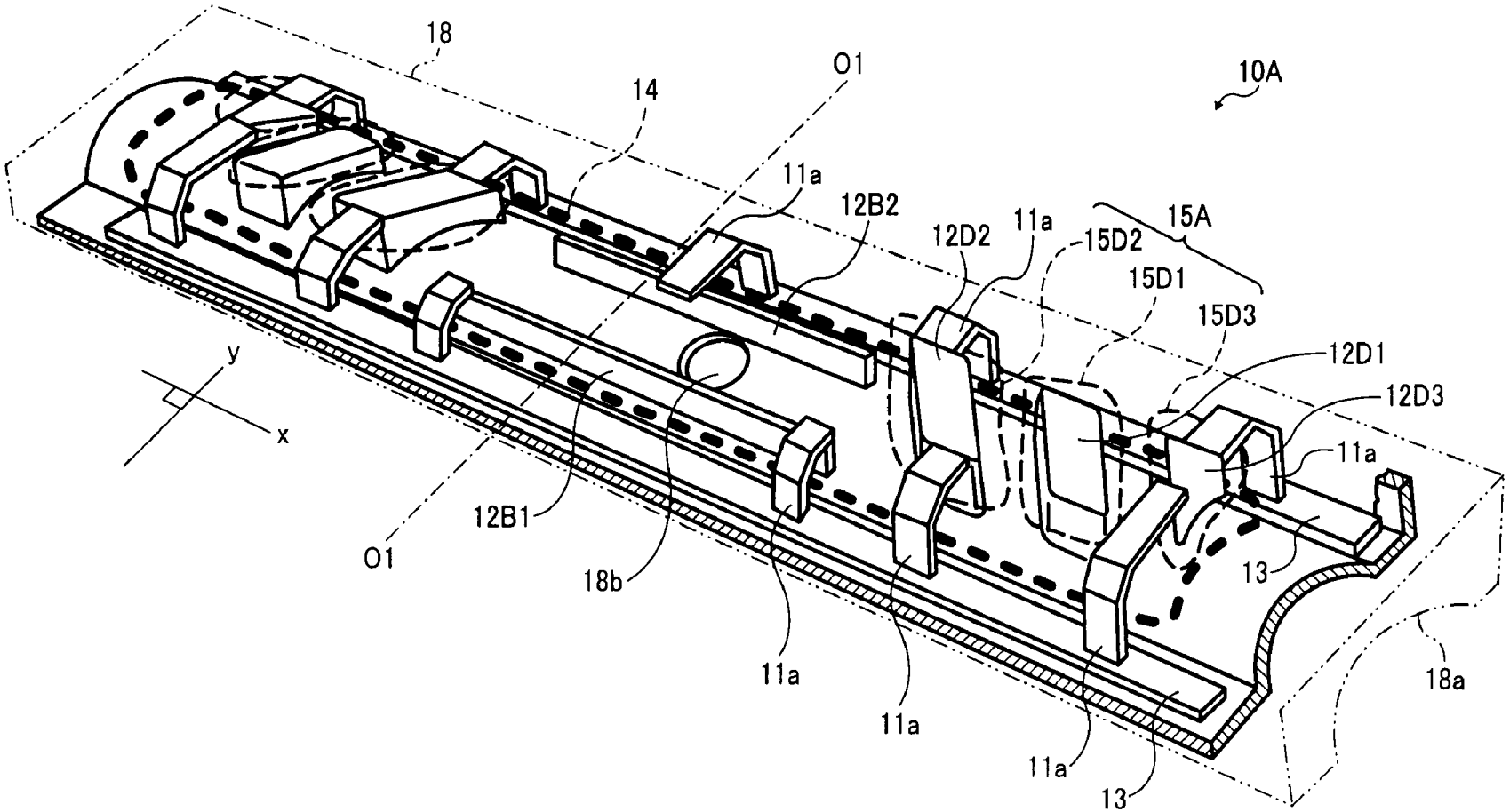
FIG. 10 is a perspective view illustrating an induction heating unit according to another illustrative embodiment.
Figure 11:
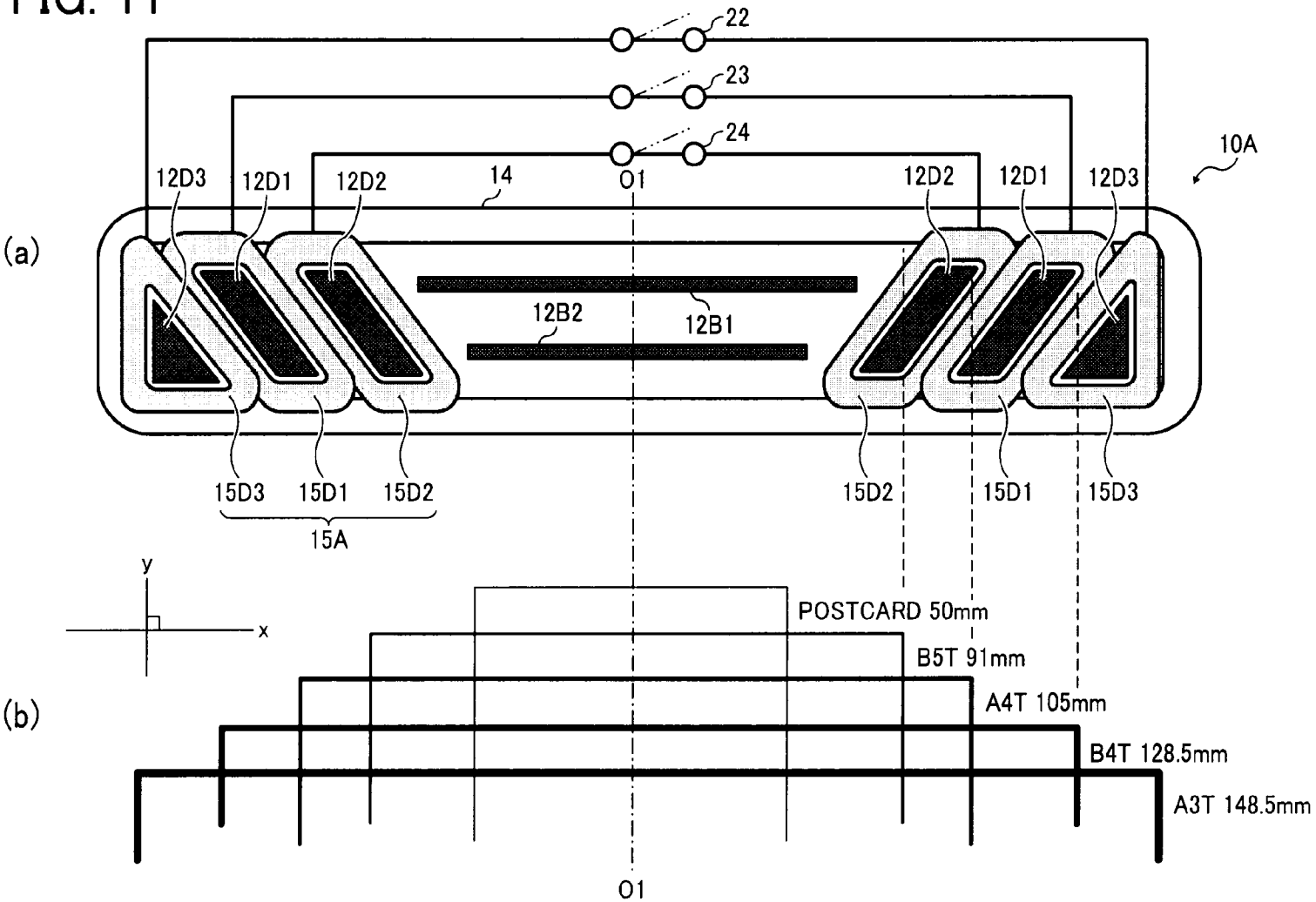
FIG. 11 illustrates relations between configurations of center cores and sheet size.

FIG. 10 is a perspective view illustrating a heat generation unit 10A, FIG. 11(*a*) illustrates components of the heat generation unit 10A projected onto the tangent plane H of the curved heat generation layer 163 shown in FIG. 1 that faces the heat generation unit 10A, and FIG. 11(*b*) shows various sheet sizes the heat generation unit 10A can accommodate.

Referring to FIGS. 10 and 11, the heat generation unit 10A includes two center cores 12D1 and 12D2 shaped like parallelogram poles and a center core 12D3 that is a substantially triangular pole in each side of an axis of symmetry O1-O1 instead of the center core 12A shown in FIG. 5. The center cores 12D1, 12D2, and 12D3 are disposed closely, and demagnetization coils 15D1, 15D2, and 15D3 are looped around the center cores 12D1, 12D2, and 12D3, respectively. The demagnetization coils 15D1, 15D2, and 15D3 together form a demagnetization coil unit 15A. The demagnetization coils 15D1, 15D2, and 15D3 respectively have shapes identical or similar to those of the center cores 12D1, 12D2, and 12D3. That is, the demagnetization coils 15D1 and 15D2 are substantially parallelograms, corresponding to the shapes of the center cores 12D1 and 12D2, and the center core 15D3 is substantially triangular, corresponding to that of the center core 12D3 as shown in FIG. 11.

The heat generation unit 10A further includes switches 22, 23, and 24 via each of which two center cores that are given identical reference characters and disposed symmetrically are connected. As shown in FIG. 11, the demagnetization coils 15D3 disposed on both sides of the axis of symmetry O1-O1 are connected via the switch 22. Similarly, the demagnetization coils 15D1 and 15D2 are connected via the switch 23 and 24, respectively. Except for the above-described configuration, all components of the heat generation unit 10A are similar to those in the previous embodiment shown in FIG. 5.

It is to be noted that, hereinafter, the demagnetization coils 15D1, 15D2, and 15D3 are simply referred to collectively as the demagnetization coils 15D when discrimination therebetween is not necessary.

The present embodiment includes the demagnetization coils 15D3, 15D1, and 15D2 arranged in the sheet width direction (x axis) from outside in that order. The first magnetic cores, that is, the center cores 12D3, 12D1, and 12D2, are respectively disposed in inner areas enclosed by the demagnetization coils 15D3, 15D1, and 15D2 and are adjacent so as to be continuous in the sheet width direction or the axial direction of the rotary heat generator (fixing roller 16).

More specifically, the center cores 12D3, 12D1, and 12D2 disposed adjacently has one or two sides oblique to the sheet width direction, and these oblique sides can overlap each other in the sheet transport direction (y axis) so as to be continuous in the sheet width direction x. Further, the center core 12D2 that is closest to a center portion in the sheet width direction can be magnetically continuous with the center cores 12B1 and/or 12B2 in the sheet width direction.

Therefore, similarly to the center cores 12A and 12B (12B1 or 12B2) shown in FIG. 5, the first magnetic cores (center cores 12D3, 12D1, and 12D2) and the second magnetic cores (center cores 12B1 and 12B2) that guide the magnetic flux to the heat generation layer 163 can be magnetically continuous in the sheet width direction.

Counteraction of induction electrical current when multiple demagnetization coils are adjacently disposed is described below with reference to FIGS. 11, 12A, and 12B.

Figure 12A:
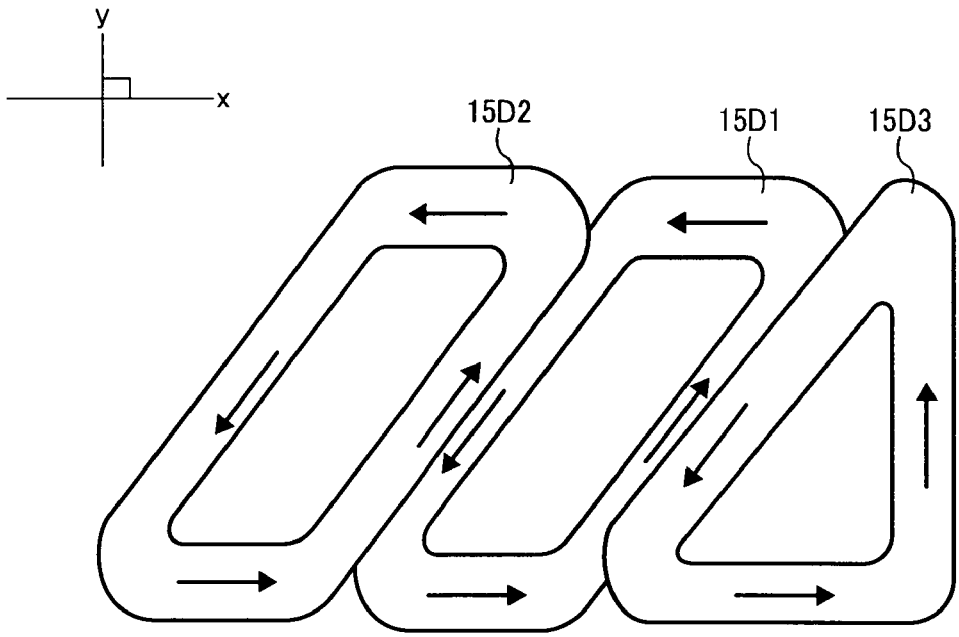
FIG. 12A illustrates counteraction of an inductive electrical current flowing in multiple demagnetization coils arranged adjacently.
Figure 12B:
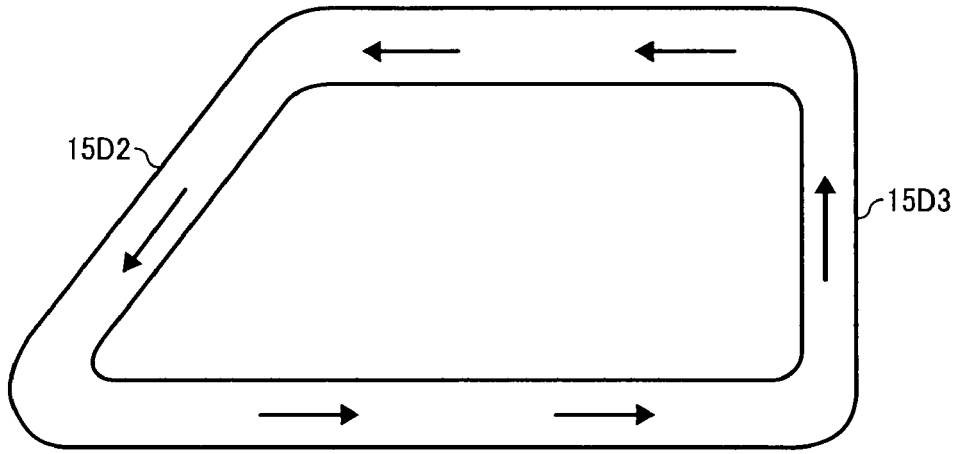
FIG. 12B illustrates flow of the inductive electrical current as a result of the counteraction shown in FIG. 12A.

FIG. 12A is an enlarged view illustrating the adjacently disposed demagnetization coils 15D.

Referring to FIGS. 11 and 12A, each demagnetization coil 15D1 is looped around each center core 12D1 that is sandwiched between the center cores 12D2 and 12D3 and has two sides oblique to the sheet width direction on the tangent plane H. By overlapping the oblique sides of the demagnetization coil 15D1 respectively with those of the demagnetization coils 15D2 and 12D3 in a direction perpendicular to the tangent plane H, a distance between the center cores 12D1 and 12D2, and a distance between the center cores 12D1 and 12D3 can be reduced, thereby achieving continuity of the center cores relatively easily.

Further, demagnetization can be performed more suitably for the respective sheet sizes by disposing the demagnetization coils 15D so that the oblique sides thereof cross edge portions of different sheet sizes in the sheet width direction, respectively. For example, the demagnetization coils 15D2, 15D1, and 15D3 can be disposed so that their oblique sides respectively cross the edge portions of B5T size, A4T size, and B4T size as shown in FIG. 11.

Additionally, when the two demagnetization coils that are given an identical reference characters and disposed symmetrically are connected, and the demagnetization coils 15D2, 15D1, and 15D3 are independently openable and closable using the switch 22, 23, or 24, demagnetization can be performed according to sheet size. In this configuration, excessive heating at the non-sheet areas can be prevented or reduced more efficiently compared to the example shown in FIG. 5 in which the first magnetic coil unit is a single unit. The demagnetization effect for respective sheet sizes in the present embodiment can be similar to cases in which size and shape of demagnetization coils are optimized for each sheet size.

In FIG. 11, the demagnetization coil units 15A are disposed symmetrically with respect to the axis of symmetry O1-O1, and the amount of excitation flux counteracted by the demagnetization coil units 15A (hereinafter "demagnetization amount") can be changed by adjusting the phase of the demagnetization electrical current induced by a power source, the amount of electrical current, and/or open-close ratio of the mechanical switches. The amount of electrical current can be controlled using a semiconductor switch. Because two demagnetization coils 15D disposed symmetrically are connected into a single circuit, the demagnetization amount on both sides of the axis of symmetry O1-O1 can be adjusted by the single circuit. The demagnetization coils 15D to be energized can be determined depending on sheet size or based on feedback of temperature using a temperature detector that detects temperatures of positions in the rotary axial direction. However, the present embodiment is not limited to these examples.

When the excitation coil 14 is energized and simultaneously the demagnetization coils 15D1, 15D2, and 15D3 are shorted (turned on), the electrical current flows through the demagnetization coil units 15D in a direction indicated by arrows in FIG. 12A. In this state, in the portions such as the right side of the demagnetization coil 15D2 and the left side of the demagnetization coil 15D1 that are parallel and overlap each other in the direction perpendicular to the tangent plane H, the electrical current flows in opposite directions. Accordingly, the demagnetization flux generated by one of the overlapping portions is counteracted by that generated by the other portion. As a result, the electrical current flows similarly to a case in which the demagnetization coil is a single unit having an exterior of the demagnetization coils 15D1, 15D2, 15D3 disposed adjacently as shown in FIG. 12B. Therefore, the demagnetization effect for respective sheet sizes in the present embodiment can be similar to cases in which the size and shape of demagnetization coils are optimized for each sheet size.

The demagnetization effects in the present embodiment are described below in further detail with respect to FIG. 13A.

Figure 13A:
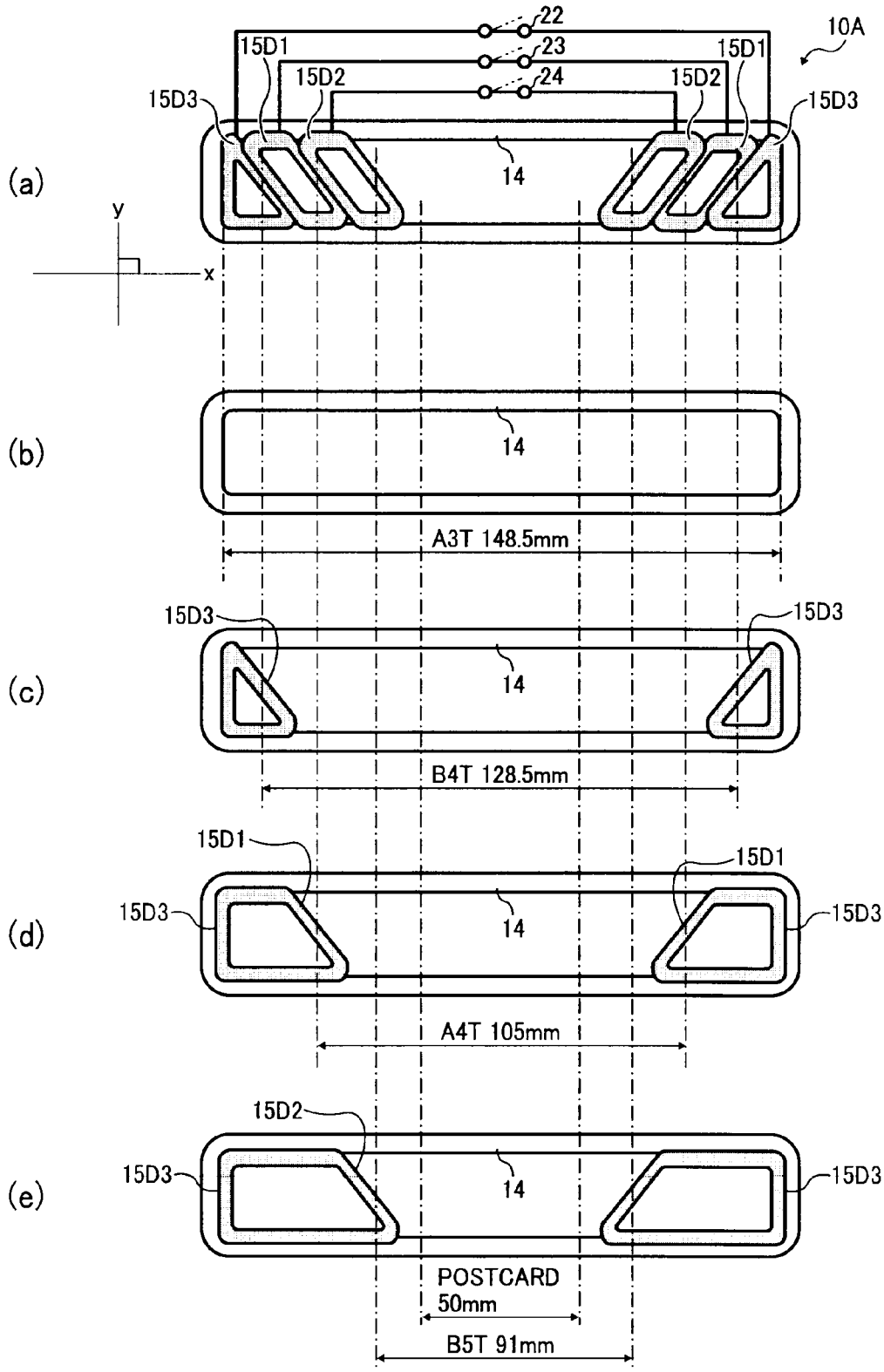
FIG. 13A schematically illustrates demagnetization effects in the induction heating unit shown in FIG. 10 for various sheet sizes that are attained by selectively switching the demagnetization coils between on and off.

In FIG. 13A, (a) schematically illustrates the induction heating unit 10A, and (b) through (e) respectively show demagnetization effects for A3T size, B4T size, A4T size, and B5T size. In the example shown in FIG. 13A, a maximum sheet size and a minimum sheet size usable in the induction heating unit 10A are A3T size and postcard size, respectively.

Referring to FIG. 13A, when all the switches 22 through 24 are off (open), the demagnetization effect is similar to a case in which no demagnetization coil is provided as shown in (b), and thus suitable for A3T size. When only the switch 22 is on, the demagnetization effect is similar to a case in which only the demagnetization coils 15D3 is provided as shown in (c) and thus suitable for B4T size.

By contrast, when the switches 22 and 23 are on, the demagnetization effect is similar to a case in which the demagnetization coils 15D1 and 15D3 are provided as shown in (d) and thus suitable for A4T size. When all the switches 22 though 24 are on, the demagnetization effect is similar to a case in which the demagnetization coils 15D1, 15D2, and 15D3 are provided as shown in (e) and thus suitable for B5T size.

As described above, the present embodiment provides a fixer that can accommodate at least two different sheet sizes whose lengths in the sheet width direction are different. The fixer is provided with the multiple demagnetization coils constituting the demagnetization coil unit. A side of each demagnetization coil is oblique to the sheet width direction or the sheet transport direction, and the oblique side crosses the edge portion of at least one sheet size. Thus, fixing performance on the edge portions of the sheet can be improved.

In the present embodiment using the multiple demagnetization coils 15D1, 15D2, and 15D3, the partial drop or significant drop in temperature of fixing roller can be prevented or reduced as well. Additionally, because the oblique sides of the demagnetization coils can make changes in the magnetic flux density more gradual compared to the configuration shown in FIG. 3A, abrupt changes in the magnetic flux density in the end portions in the sheet width direction can be prevented or reduced, preventing or reducing unevenness in fixing temperature in the sheet width direction as well as unevenness in gloss of resultant images.

It is to be noted that, although the descriptions above concern the configuration in which the parallelogram-pole shaped coils and triangular-pole shaped coils are used together, alternatively, a parallelogram, a triangle, and a trapezium can be used alone or in combination as the shape of the demagnetization coils.

FIG. 13B shows evaluation results of images fixed by the fixer including the induction heating unit 10A shown in FIG. 11 according to the present embodiment.

To evaluate fixing performance, images were fixed at a linear velocity of about 230 mm/s, and demagnetization was performed while excitation coil 14 was energized. It is to be noted that timings of demagnetization control is not limited to a specific example. As shown in FIG. 13B, excessive heating at the end portions and faxing failure due to insufficient fixing temperature were prevented.

The shape of the demagnetization coils are described below in further detail using comparative examples in which the demagnetization coils have an curved end portion and their shapes are symmetrical with respect to the rotary axial line.

Figure 14A:
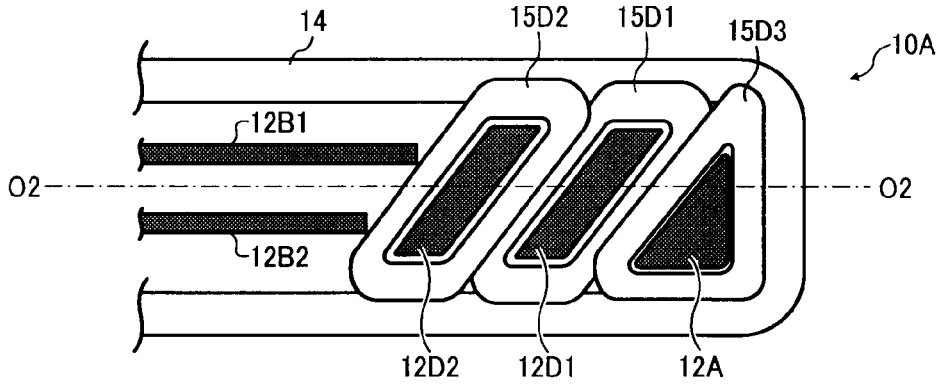
FIG. 14A illustrates arrangement of the demagnetization coils in the induction heating unit shown in FIG. 10.
Figure 14B:
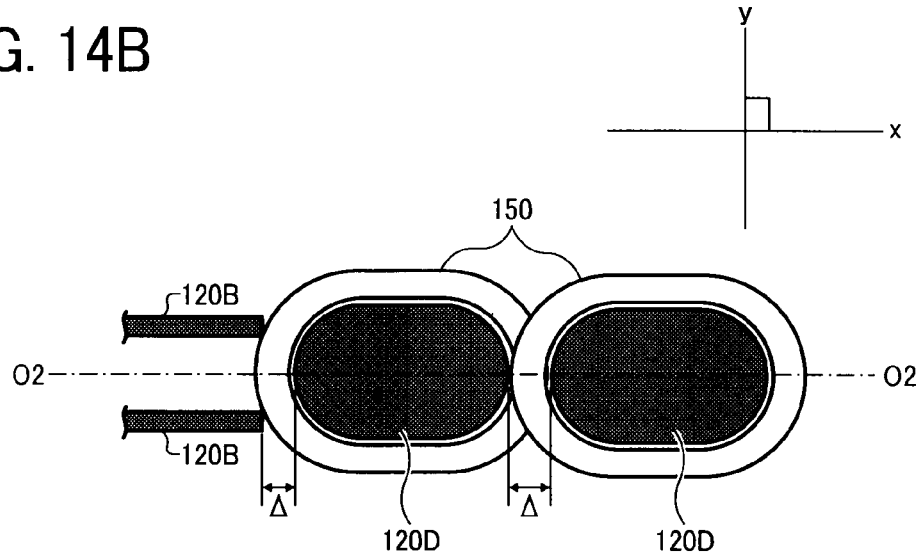
FIGS. 14B and 14C respectively illustrate arrangement of demagnetization coils according to comparative examples.
Figure 14C:
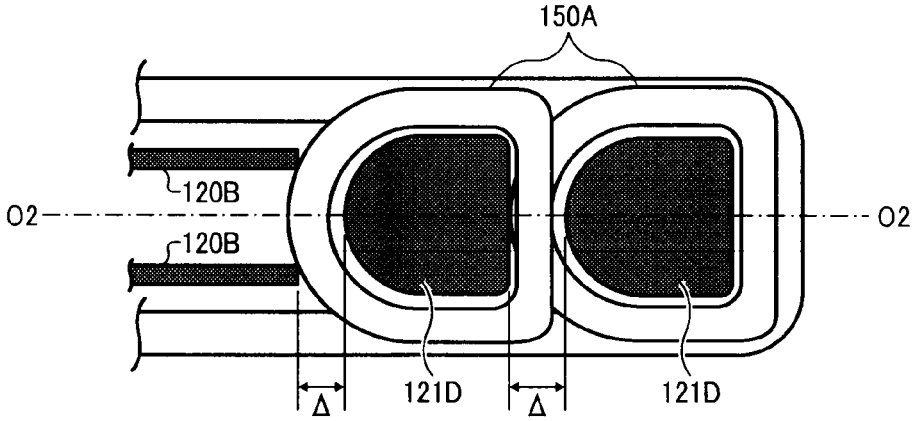

FIGS. 14A, 14B, and 14C respectively illustrate the fixer 10A according to the present embodiment, comparative demagnetization coils 150, and comparative demagnetization coils 150A projected on the tangent plane H.

In the examples shown in FIGS. 14B and 14C, comparative demagnetization coils 150 and 150A are respectively looped around center cores 120D and 121*d* serving as first magnetic cores, and the center cores 120D and 121D and center cores 120B serving as second magnetic cores are arranged in the sheet width direction. In FIG. 14B, both end portions of each demagnetization coil 150 in the sheet width direction are curved and symmetrical with respect to the rotary axial line O2-O2. In FIG. 14C, one end portion of each demagnetization coil 150A is curved and symmetrical with respect to the rotary axial line O2-O2.

Both examples shown in FIGS. 14B and 14C have features of the present embodiment, that is, multiple demagnetization coils 150 or 150A are provided in accordance with sheet size, and portions of the demagnetization coils 150 or 150A that are adjacent are superimposed one on another. However, it is clear from FIGS. 14B and 14C that, in the cases in which the demagnetization coils are symmetrical with respect to the rotary axial line O2-O2, the center cores 120D or 121D (first magnetic core) and the center core 120B (second magnetic core) cannot be magnetically continuous in the sheet width direction because a gap Δ is present due to a width of the center cores 120D or 121D.

Figure 15:
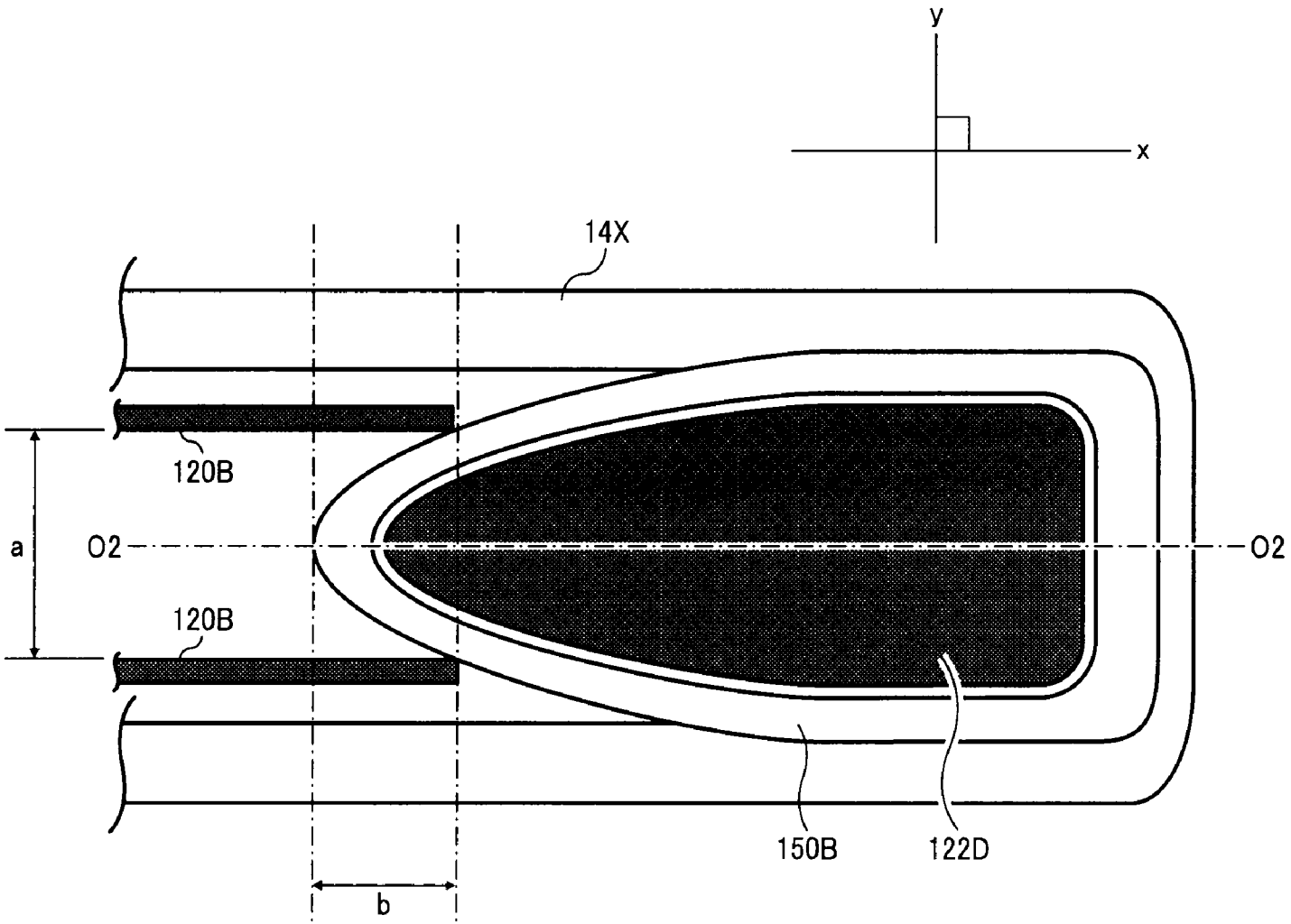
FIG. 15 illustrates a demagnetization coil according to another comparative example.

FIG. 15 illustrates another comparative demagnetization coils that have a curved end portion and the shape thereof is symmetrical with respect to the rotary axial line.

Referring to FIG. 15, even if a curved end portion of a center core 122D and a demagnetization coil 150B is rather sharp so as to attain continuity between center cores 120B and the center core 122D, there can be an area b in which magnetic flux generated by the demagnetization coil 150B is blocked by the center core 120B. More specifically, in the area b, the magnetic flux generated by the demagnetization coil 150B hardly acts on an upper portion and a lower portion of an excitation coil 14X in FIG. 15 due to the center cores 120B. In other words, the portion of the demagnetization coil 150B disposed in the area b is useless, and thus the configuration shown in FIG. 15 is not effective.

Figure 16A:
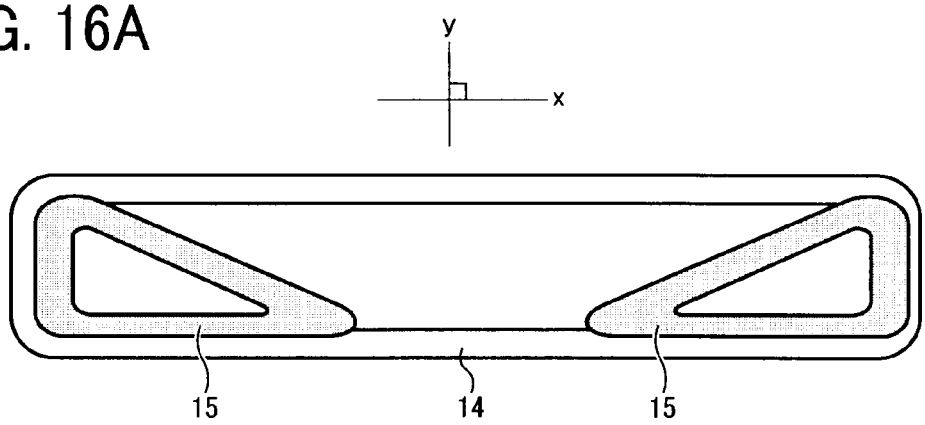
FIGS. 16A, 16B, and 16C respectively illustrate examples of outlines of the demagnetization coils shown in FIG. 10.
Figure 16B:
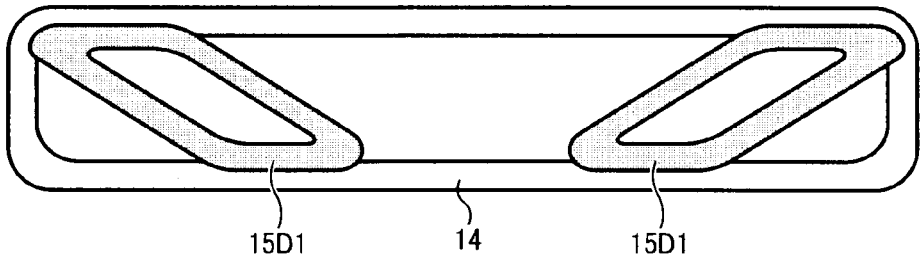
Figure 16C:
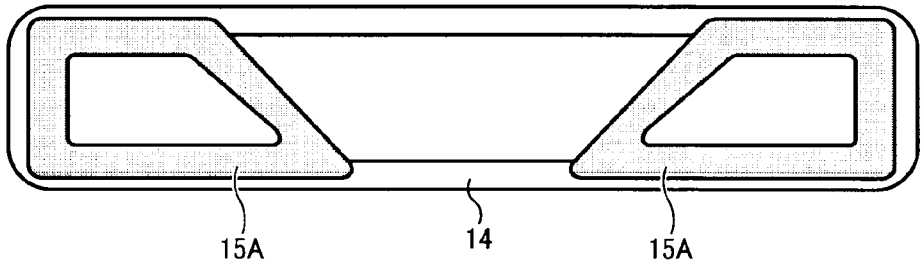
Figure 17:
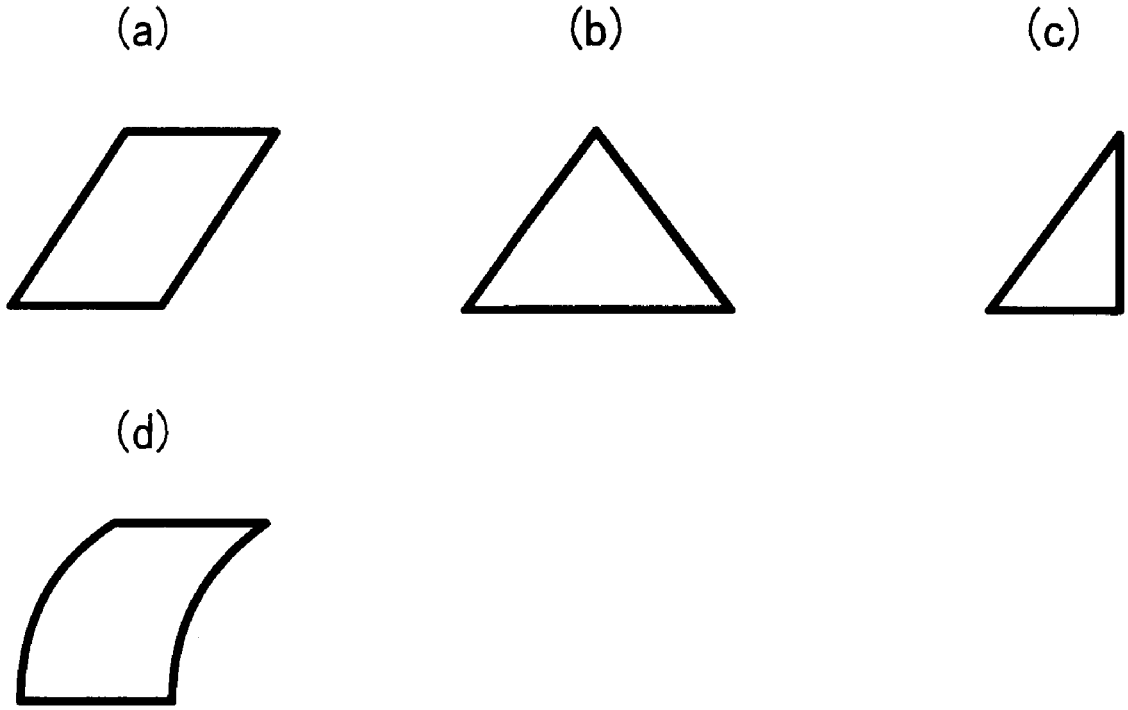
FIG. 17 illustrates examples of shapes for forming the outlines of the demagnetization coils shown in FIGS. 16A, 16B, and 16C.

FIGS. 16A, 16B, and 16C respectively illustrate examples of outlines of the demagnetization coil units according to the illustrative embodiments of the present invention, projected on the tangent plane H described with reference to FIG. 6. FIGS. 16A, 16B, and 16C, respectively illustrate the substantially right-angle triangular demagnetization coil units 15, the parallelogram-shaped demagnetization coils 15D1, and trapezium-shaped demagnetization coil units 15A. These shapes can be attained using examples shown in FIG. 17, (a) a substantial parallelogram, (b) a triangle, (c) a right-angle or substantially right-angle triangle, and (d) a deformed parallelogram having curved two sides that face each other, alone or in combination.

Figure 18A:
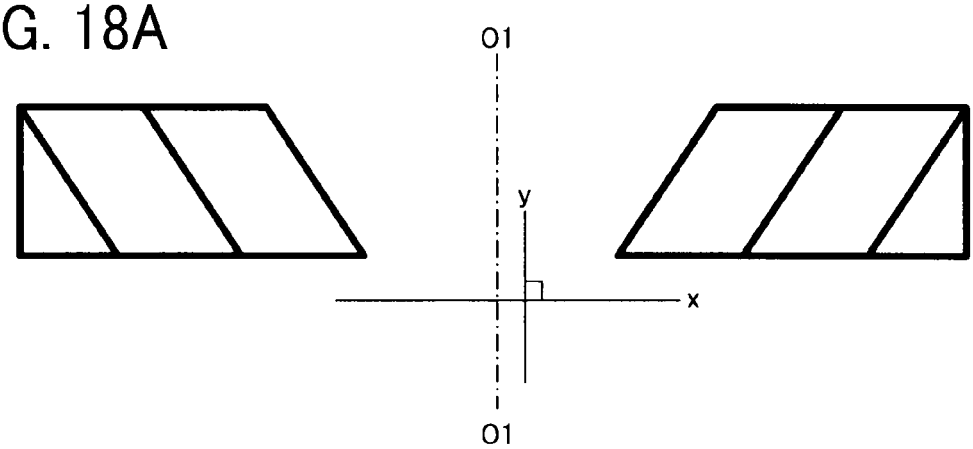
FIGS. 18A, 18B, and 18C respectively illustrate combinations of the shapes shown in FIG. 17 for forming the outlines of the demagnetization coils shown in FIGS. 16A, 16B, and 16C.
Figure 18B:
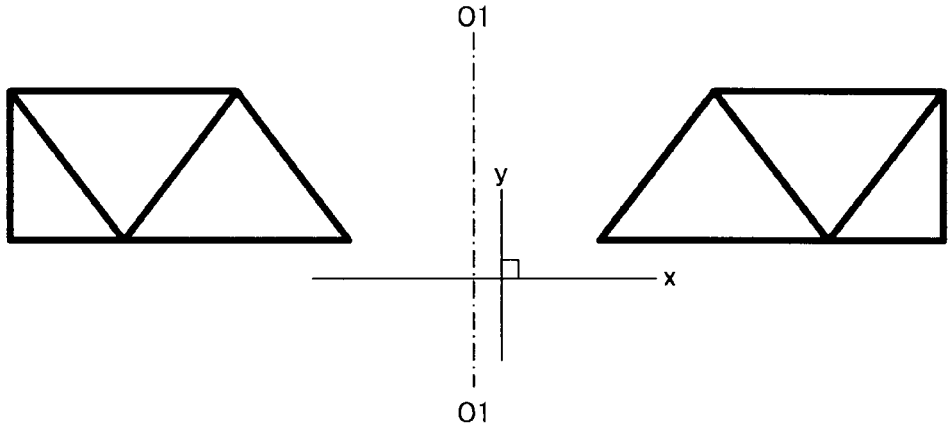
Figure 18C:
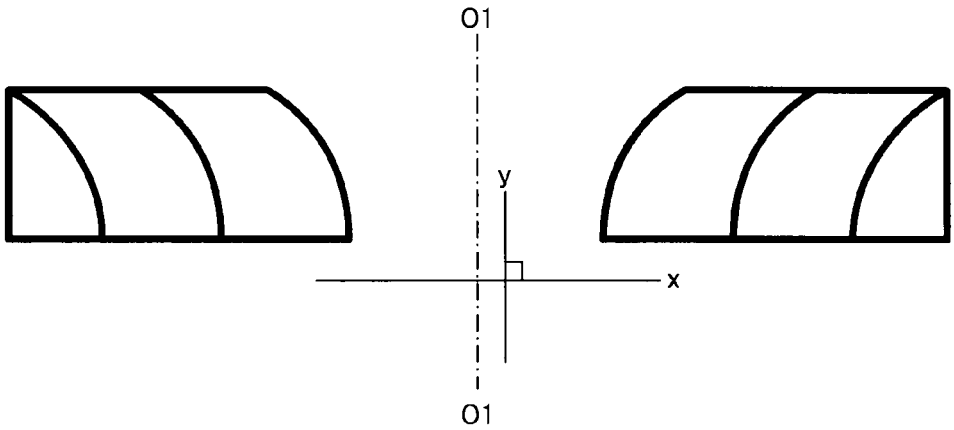

FIGS. 18A, 18B, and 18C respectively illustrate combinations of the above-described shapes to form the demagnetization coil units.

FIG. 18A illustrates an example in which the shape of the demagnetization coil unit is formed by the combination of a substantial parallelogram and a triangle. FIG. 18B illustrates an example in which the shape of the demagnetization coil unit is formed by the combination of a regular or substantially regular triangle and a right-angle or substantially right-angle triangle. FIG. 18C illustrates an example in which the shape of the demagnetization coil unit is formed by the combination of the deformed parallelogram shown in FIG. 17(*d*) and a deformed right-angle triangle. In FIGS. 18A, 18B, and 18C, the demagnetization coils are symmetrically disposed on both sides of the axis of symmetry O1-O1.

Next, descriptions will be made below of another examples of fixers to which the above-described induction heating unit according to the illustrative embodiments of the present invention can be applied with reference to FIGS. 19, 20, and 21.

Figure 19:
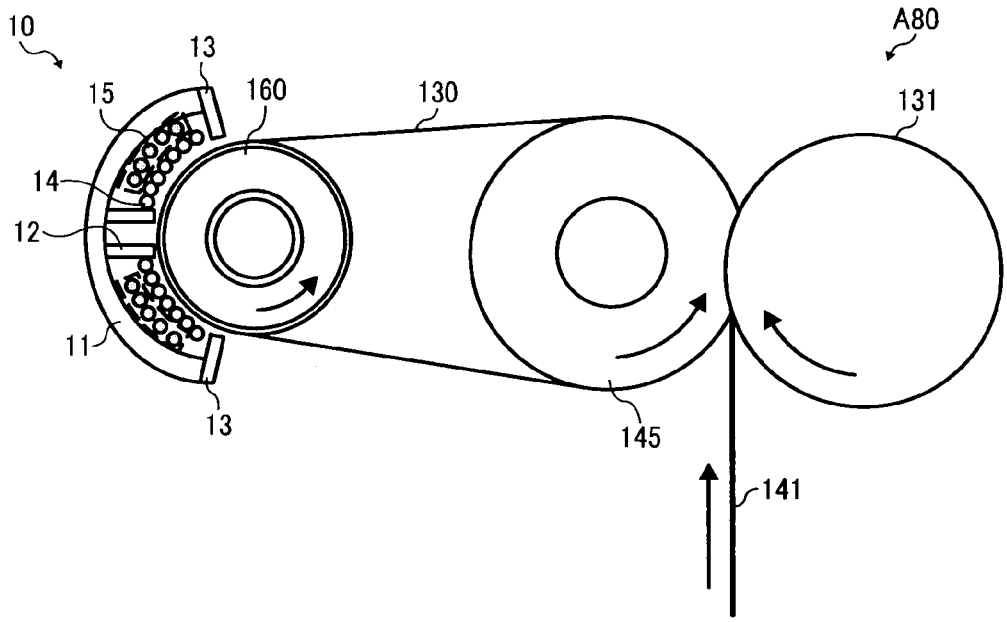
FIG. 19 illustrates a configuration of a fixer according to another illustrative embodiment.

FIG. 19 illustrates a fixer that includes a fixing heat generation belt 130 as a rotary heat generator.

As shown in FIG. 19, a fixer A80 includes an induction heating unit 10, the fixing heat generation belt 130 looped around a roller 145 serving as a rotary fixing member and a support roller 160, and a rotary pressure member 131. Thus, the fixing heat generation belt 130, the roller 145, and the support roller 160 together serve as a fixing member. The fixing heat generation belt 130 is rotated by the roller 145 and the support roller 160. The fixing heat generation belt 130 includes a heat generation layer that is inductively heated by the induction heating unit 10. The rotary pressure member 131 presses against the roller 145 via the fixing heat generation belt 130. The fixer A80 fixes an image on a sheet 141 passing through a fixing nip formed between the rotary pressure member 131 and the roller 145 via the fixing heat generation belt 130.

Figure 20:
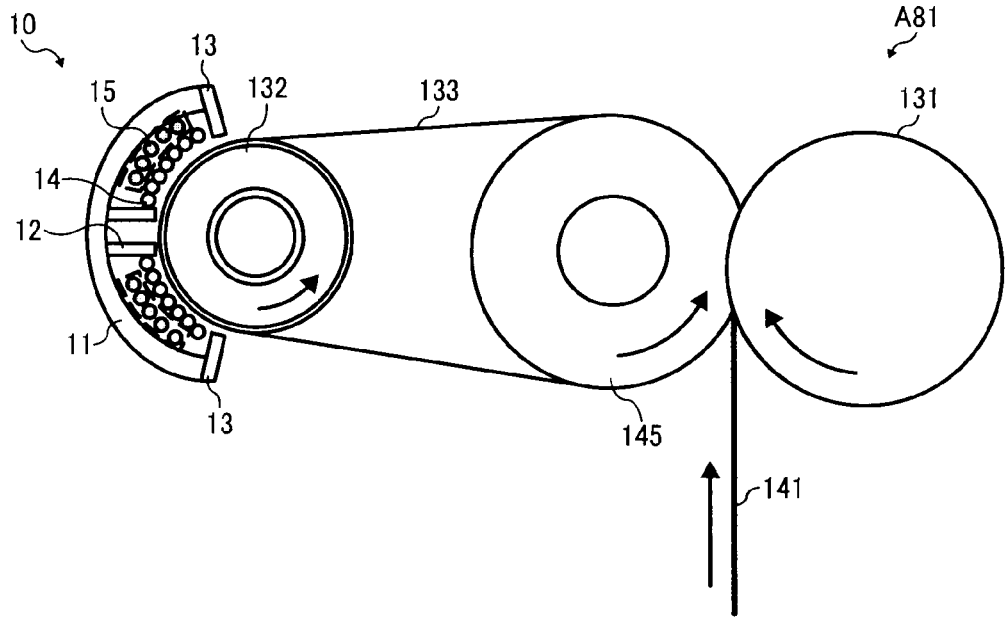
FIG. 20 illustrates a configuration of a fixer according to another illustrative embodiment.

FIG. 20 illustrates a fixer according to another embodiment that includes a heating roller 132 as a rotary heat generator.

As shown in FIG. 20, a fixer A81 includes an induction heating unit 10, a rotary pressure member 131, the heating roller 132, and a fixing belt 133 looped around the heating roller 132 and a roller 145. The heating roller 132 includes a heat generation layer that is inductively heated by the induction heating unit 10. Thus, the heating roller 132, the fixing belt 133, and the roller 145 together serve as a fixing member. The fixer A81 fixes an image on a sheet 141 passing through a fixing nip formed between the rotary pressure member 131 and the roller 145 via the fixing belt 133 that is heated by the heating roller 132.

Figure 21:
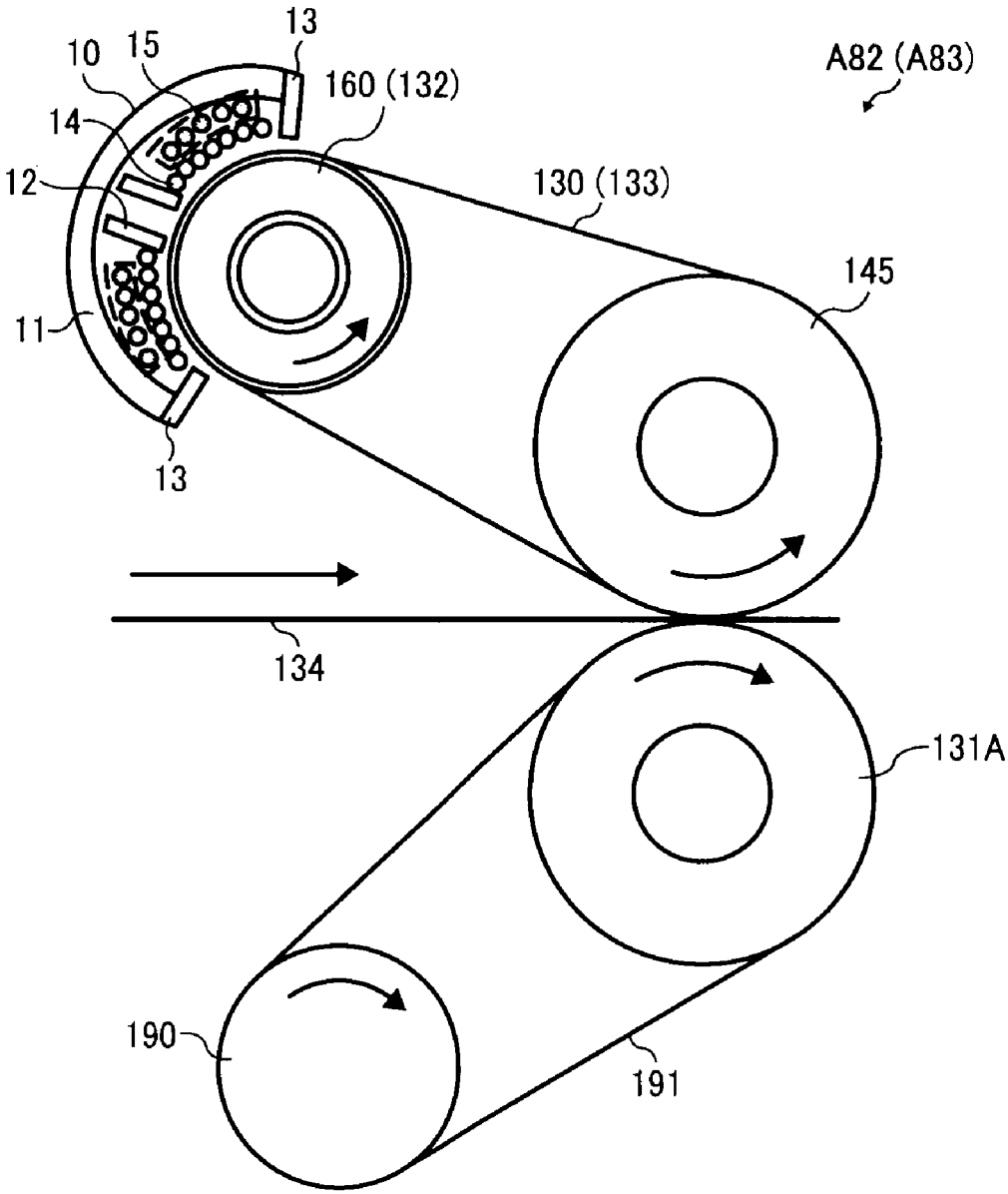
FIG. 21 illustrates configurations of a fixer according to another illustrative embodiment.

FIG. 21 illustrates fixers A82 and A83 that are respectively variations of the embodiments shown in FIGS. 19 and 20.

Referring to FIG. 21, as the variation of the embodiment shown in FIG. 19, a fixer A82 includes a rotary pressure member 131A, a support roller 190, and a pressure belt 191 looped around these rollers. The fixer A82 further includes an induction heating unit 10 and a fixing heat generation belt 130, serving as a rotary heat generator, looped around a roller 145 and a support roller 160 similarly to the fixer A80 shown in FIG. 19. The fixer A82 fixes an image on a sheet 141 passing through a fixing nip formed between pressure belt 191 and the roller 145 via the fixing heat generation belt 130.

As the variation of the embodiments shown in FIG. 20, the fixer A83 includes a heating roller 132 serving as a rotary heat generator and a fixing belt 133 instead of the support roller 160 and the fixing heat generation belt 130 of the fixer A82. The fixer A83 fixes an image on a sheet 141 passing through a fixing nip formed between pressure belt 191 and the roller 145 via the fixing belt 133 that is heated by the heating roller 132.

Now, descriptions will be made below of an image forming apparatus to which the fixer according to various illustrative embodiments of the present invention is applied with reference to FIG. 22.

Figure 22:
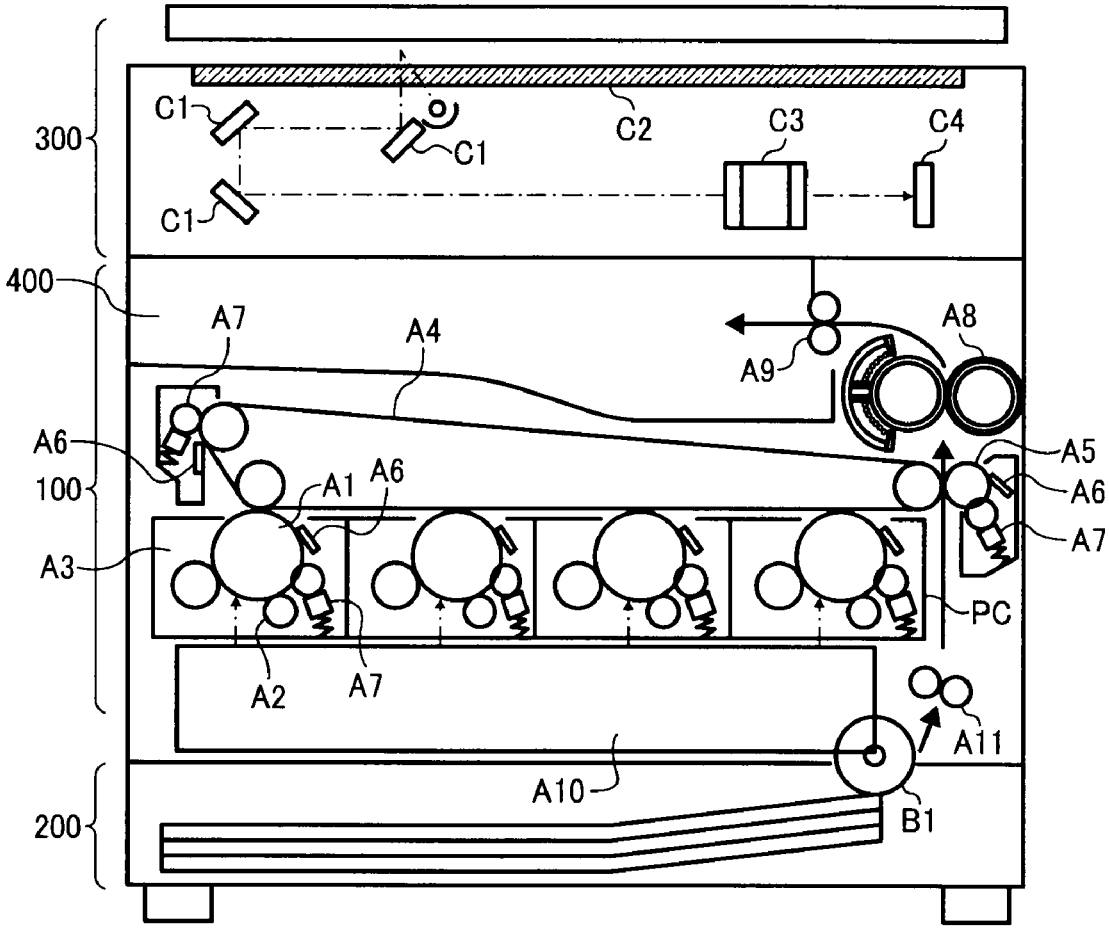
FIG. 22 illustrates a configuration of an image forming apparatus according to an illustrative embodiment of the present invention.

FIG. 22 illustrates a configuration of the image forming apparatus.

This image forming apparatus is housing-internal discharge type, that is, a sheet discharge space is provided inside a housing thereof. The image forming apparatus includes a printer unit 100, a sheet feeder 200 disposed beneath the printer unit 100, a reading unit 300, a sheet discharge space 400, and a controller, not shown, that controls various functions of the image forming apparatus. Another sheet feeder can be provided in a bottom portion of the image forming apparatus as necessary. The reading unit 300 reads image information of an original document and is provided above the printer unit 100 via the sheet discharge space 400. The sheet feeder 200 contains sheets of recording media, which is transported through the printer unit 100 along a sheet path indicated by solid arrows in FIG. 22. The printer unit 100 forms images on the sheets and then discharges the sheets into the sheet discharge space 400.

The image forming apparatus in the present embodiment is a tandem type electronographic image forming apparatus employing an intermediate transfer (indirect transfer) method. The printer unit 100 includes an intermediate transfer belt A4 disposed above four drum-shaped photoreceptors A1 serving as image carriers. The intermediate transfer belt A4 is looped around multiple support rollers including a driving roller and a driven roller and moves rotatably. On the photoreceptors A1, yellow, cyan, magenta, and black toner images are respectively formed.

Around each photoreceptor A1, a charger A2 for charging a surface of the photoreceptor A1 uniformly, a developing unit A3 for developing an electrostatic latent image formed on the photoreceptor A1 into a toner image, a cleaning device A6 for cleaning the surface of the photoreceptor A1, a lubricator unit A7 for reducing a frictional coefficient of the surface of the photoreceptor A1, and a primary transfer roller (bias roller), not shown, are provided. The primary transfer rollers and the intermediate transfer belt A4 together serve as an intermediate transfer unit. The printer unit 100 further includes a secondary transfer unit A5, an exposure unit A10 located beneath the photoreceptors A1, a fixer A8, a pair of registration rollers A11, and a pair of discharge rollers A9. The primary transfer rollers respectively transfer the images formed on the photoreceptors A1 onto a surface of the intermediate transfer belt A4 in a primary transfer process. Then, the secondary transfer unit A5 transfers an image from the intermediate transfer belt A4 onto the sheet in a secondary transfer process.

For easy maintenance, at least two of the photoreceptor A1, the charger A2, the developing unit A3, the cleaning unit A6, and the lubricator unit A7 are united as a single process cartridge PC that is detachably attachable to the printer unit 100. The printer unit 100 further includes another cleaning device A6 and lubricator unit A7 that are united as a single unit that is detachably attachable to the printer unit 100 for each of the intermediate transfer belt A4 and the secondary transfer unit A5.

The sheet feeder 200 includes a sheet cassette, not shown, and a feed roller B1 that feed the sheets contained in the sheet cassette to the printer unit 100.

The reading unit 300 includes a reading carriage C1, a contact glass C2, a lens C3, and a CCD (Charge-Coupled Device) C4. The reading carriage C1 includes a light source that lights the original document placed on the contact glass C2 and a mirror that reflects the light reflected by a surface of the original document as the image information to the lens C3 while moving back and forth. The CCD C4 is disposed downstream from the lens C3 in a direction in which the image information is transmitted. The CCD C4 separates the image information into three primary colors and converts it photoelectrically, digitalizing the image information into image signals.

Subsequently, the exposure unit A10 directs laser lights emitted from laser diodes, not shown, onto the surfaces of the photoreceptors A1, forming electrostatic latent images thereon. It is to be noted that the laser lights from the laser diodes can be directed onto the photoreceptors A1 via a known polygon mirror and lenses, not shown.

In the printer unit 100, the charger A2 includes a charge member and a pressurizer, not shown, that presses the charge member against the photoreceptor A1 with a predetermined or given pressure. The charge member includes an electrically conductive shaft and an electrically conductive elastic layer disposed over the shaft that. The conductive shaft applies a predetermined or given voltage from a voltage applicator, not shown, to a gap between the conductive elastic layer and the photoreceptor A1, giving electrical charges onto the surface of the photoreceptor A1. The developing unit A3 includes an agitation screw, a developing roller, and a doctor, not shown. The agitation screw agitates developer including toner and carrier, and the developer magnetically adheres to the developing roller, forming a developer layer. The doctor regulates the thickness of developer layer on the developing roller. As the developing roller rotates, through an opening of the developing unit A3 facing the photoreceptor A1, the toner included in the developer adheres to the electrostatic latent image on the photoreceptor A1, developing the electrostatic latent image.

The developed image (toner image) is then electrically transferred from the photoreceptor A1 onto the intermediate transfer belt A4 by the primary transfer roller. The cleaning unit A6 includes a cleaning blade and a cleaning brush, for example, and removes any toner remaining on the photoreceptor A1 after the primary transfer process.

The lubricator unit A7 includes a roller-shaped lubricant applicator including a metal shaft and a brush wound around the shaft, a solid lubricant pressed against the lubricant applicator under its own weight. The lubricant applicator chips powder lubricant from the solid lubricant and then applies the powder lubricant to the surface of the photoreceptor A1 while rotating. It is to be noted that the lubricator unit A7 lubricates the photoreceptor A1 almost entirely, that is, the area lubricated by the lubricator unit A7 is larger than an effective cleaning area cleaned by the cleaning unit A6. This is because the lubricant should be applied to an entire area covered by the cleaning blade although the effective cleaning area depends on cleaning performance of the cleaning unit A6.

Alternatively, the lubricator unit A7 can further include a bias member that presses the solid lubricant against the lubricant applicator.

The cleaning unit A6 and the lubricator unit A7 for the intermediate transfer belt A4 are housed in a single housing as a transfer cartridge. While rotating in a direction identical to the direction in which the intermediate transfer belt A4 rotates, the brush roller rubs the toner and the like adhered to the surface of the intermediate transfer belt A4 after the secondary transfer process. The cleaning blade contacts the intermediate transfer belt A4 at a predetermined or given angle with a predetermined or given pressure and removes the toner and the like adhered thereto.

As the solid lubricant, dry solid hydrophobic lubricant can be used. Examples thereof include compounds including a stearate group such as zinc stearate, barium stearate, lead stearate, iron stearate, nickel stearate, cobalt stearate, copper stearate, strontium stearate, calcium stearate, cadmium stearate, and magnesium stearate. In addition, compounds including an identical fatty acid group such as zinc oleate, manganese oleate, iron oleate, cobalt oleate, lead oleate, magnesium oleate, and copper oleate; and zinc palmitate, cobalt palmitate, copper palmitate, magnesium palmitate, aluminum palmitate, and calcium palmitate can be used. Other examples include fatty acids such as lead caprylate, lead caproate, zinc linolenate, cobalt linolenate, calcium linolenate, and cadmium lyco-linolenate; metal salts of those fatty acids; and waxes such as candelilla wax, carnauba wax, rice wax, Japan wax, jojoba oil, beeswax, and the lanoline.

Processes of multicolor image formation using the above-described image forming apparatus are described below.

It is to be noted that, in the present embodiment, the sheets are output with their image surfaces down so that the sheets are stacked on a discharge tray in sequential order when image data is recorded in multiple sheets in a single print job.

When the image forming apparatus is activated, the photoreceptors A1 that contact the intermediate transfer belt A4 start rotating. In the present embodiment, formation of a yellow image is initially started.

The exposure unit A10 directs laser light according to yellow image data onto the surface of the photoreceptor A1 for yellow that is uniformly charged by the charger A2, and thus an electrostatic latent image for yellow is formed. Subsequently, the developing unit A3 develops the electrostatic latent image, forming a yellow toner image, and then the primary transfer roller transfers the toner image onto the intermediate transfer belt A4. Similarly, cyan, magenta, and black images are formed on the respective photoreceptors A1 and transferred therefrom, and thus the respective single-color images are superimposed one on another on the intermediate transfer belt A4 into a multicolor image. As the intermediate transfer belt A4 rotates, this multicolor image is transported to a portion facing the secondary transfer unit A5, that is, a secondary transfer position.

Simultaneously with the above-described operations, in the sheet feeder 200, the sheets contained in the sheet cassette are fed from the top one by one to the registration rollers A11 as the feed roller B1 rotates. The registration rollers A11 stop the sheet and then rotate to forward the sheet to the secondary transfer position in such a timely manner that a leading edge of the sheet and the multicolor image on the intermediate transfer belt A4 are in a proper positional relationship.

At the secondary transfer position, the multicolor image on the intermediate transfer belt A4 is transferred onto a first side of the sheet. Subsequently, the cleaning unit A7 for the intermediate transfer belt A4 cleans the surface thereof. The sheet onto which the image is transferred is then transported to the fixer A8, where the image is fused with heat, mixing the four color toners, and then fixed on the sheet with pressure.

As the fixer A8 can heat the image promptly, productivity in image formation can be increased. Further, high image quality can be attained even when images are printed on a large number of sheets in succession. As described above, hot offset as well as fixing failure due to insufficient fixing temperature can be prevented or reduced even when images are printed on various sizes of sheets in succession. Additionally, power for the fixer A8 can be adjusted depending on image size using the controller.

After passing through the fixer A8, the sheet is transported carefully until the fused image is completely fixed on the sheet so that the image is not rubbed or disturbed by a sheet guide member and the like. Then, the discharge rollers A9 discharge the sheet onto the discharge tray with their first sides (image surfaces) down. As a sheet subsequently output is stacked over the sheet output on the discharge tray in a print job that includes image data to be recorded in multiple sheets, the sheets can be output in sequential order.

It is to be noted that, although the description above concerns a tandem type multicolor image forming apparatus employing an intermediate transfer method, the fixers according various embodiments of the present invention can be adopted to a monochrome image forming apparatus, a direct-transfer image forming apparatus, and a one-drum type image forming apparatus.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixer for fixing an image on a sheet of recording media, comprising:

a fixing member including a rotary heat generator;

a pressure member to form a nip with the fixing member to sandwich the sheet therebetween;

an excitation coil disposed facing a heat generation layer of the rotary heat generator, to generate magnetic flux that inductively heats the heat generation layer;

a loop-shaped demagnetization coil unit disposed facing the heat generation layer, to generate magnetic flux that partly counteracts the magnetic flux generated by the excitation coil;

a first area enclosed by both the excitation coil and the demagnetization coil unit;

a first magnetic core disposed in the first area;

a second area located outside a loop of the demagnetization coil unit and enclosed by the excitation coil; and a second magnetic core disposed in the second area, the second magnetic core being magnetically continuous with the first magnetic core in a rotary axial direction of the rotary heat generator.

2. The fixer according to claim 1, wherein the first magnetic core and the second magnetic core are physically continuous in the rotary axial direction of the rotary heat generator.

3. The fixer according to claim 1, wherein the demagnetization coil unit is asymmetrical about the rotary axis when being projected on a tangent plane of the heat generation layer.

4. The fixer according to claim 3, wherein the loop of the demagnetization coil unit is shaped like one of a triangle, a parallelogram, and a trapezium.

5. The fixer according to claim 4, wherein a shape of the first magnetic core is similar to that of the looped-shaped demagnetization coil unit.

6. The fixer according to claim 4, wherein the fixer accommodates at least three different sheet sizes whose lengths in the rotary axial direction are different, a portion of the demagnetization coil unit is oblique to the rotary axial direction when projected onto the tangent plane, and the oblique portion crosses an edge portion in the rotary axial direction of at least one of the sheet sizes except two sheet sizes whose lengths in the rotary axial direction of the rotary heat generator are respectively largest and smallest among the at least three different sheet sizes.

7. The fixer according to claim 1, wherein the demagnetization coil unit is constituted as multiple demagnetization coils arranged in the rotary axial direction of the rotary heat generator, the first magnetic core is constituted as multiple cores each of which is disposed in the first area and enclosed by one of the multiple coils, and two of the multiple cores of the first magnetic core disposed adjacent are magnetically continuous in the rotary axial direction and continuously guide the magnetic flux to the heat generation layer.

8. The fixer according to claim 7, wherein the two of the multiple cores of the first magnetic cores disposed adjacent are physically continuous in the rotary axial direction of the rotary heat generator.

9. The fixer according to claim 7, wherein each of the multiple demagnetization coils is shaped like one of a triangle, a parallelogram, and a trapezium when projected onto the tangent plane, and the demagnetization coil unit is constituted as a combination of two or more of the demagnetization coils arranged in the rotary axial direction.

10. The fixer according to claim 9, wherein at least one side of the demagnetization coil parallels a side of the demagnetization coil adjacent thereto.

11. The fixer according to claim 10, wherein the sides of the two adjacent demagnetization coils that are parallel overlap each other in a direction perpendicular to the tangent plane.

12. The fixer according to claim 9, wherein each of the multiple demagnetization coils and the core enclosed thereby that is a part of the first magnetic core have a similar shape.

13. The fixer according to claim 9, wherein the fixer accommodate at least two different sheet sizes whose lengths in the rotary axial direction are different, a portion of each of the multiple demagnetization coils is oblique to the sheet width direction when projected onto the tangent plane, and the oblique portion crosses an edge portion in the rotary axial direction of at least one of the sheet sizes.

14. The fixer according to claim 1, further comprising:

a second demagnetization coil unit, wherein, when projected onto a tangent plane of the heat generation layer, the demagnetization coil unit and the second demagnetization coil unit are disposed symmetrically about a center portion of the heat generation layer in the rotary axial direction, and the demagnetization coil unit and the second demagnetization coil unit disposed symmetrically are connected via a switch.

15. The fixer according to claim 1, wherein the excitation coil is connected to a power source and driven thereby.

16. The fixer according to claim 1, wherein the rotary heating generator is one of a fixing sleeve, a heating roller, and a fixing heat generation belt, the pressure member presses against the rotary heat generator, and the image is fixed on the sheet while the sheet is being transported between the rotary heat generator and the pressure member.

17. The fixer according to claim 1, wherein the rotary heating generator is a heating roller, the fixing member includes the heating roller, a rotary fixing member, and a fixing belt looped around the heating roller and the rotary fixing member, and the pressure member is a rotary pressure member.

18. The fixer according to claim 16, wherein the pressure member is one of a pressure roller and a pressure belt.

19. An image forming apparatus comprising:

an image carrier on which an electrostatic latent image is formed;

a developing unit disposed facing the image carrier to develop the electrostatic latent image with developer;

a transfer unit to transfer the developed image onto a sheet of recording media; and a fixer to fix the image on the sheet including:

a fixing member including a rotary heat generator;

a pressure member to form a nip with the fixing member to sandwich the sheet;

an excitation coil disposed facing a heat generation layer of the rotary heat generator, to generate magnetic flux that inductively heats the heat generation layer;

a loop-shaped demagnetization coil unit disposed facing the heat generation layer, to generate magnetic flux that partly counteracts the magnetic flux generated by the excitation coil;

a first area enclosed by both the excitation coil and the demagnetization coil unit;

a first magnetic core disposed in the first area;

a second area located outside a loop of the demagnetization coil unit and enclosed by the excitation coil; and a second magnetic core disposed in the second area, the second magnetic core being magnetically continuous with the first magnetic core in a rotary axial direction of the rotary heat generator.

* * * * *